US009702652B1

(12) United States Patent
Jackson

(10) Patent No.: US 9,702,652 B1
(45) Date of Patent: Jul. 11, 2017

(54) RIFLE BARREL NUT AND METHODS FOR COUPLING FIREARM COMPONENTS

(71) Applicant: Jason D. Jackson, Virginia Beach, VA (US)

(72) Inventor: Jason D. Jackson, Virginia Beach, VA (US)

(73) Assignee: Artisan Defense LLC, Virginia Beach, VA (US)

( * ) Notice: Subject to any disclaimer, the term of this patent is extended or adjusted under 35 U.S.C. 154(b) by 0 days.

(21) Appl. No.: 15/071,892

(22) Filed: Mar. 16, 2016

(51) Int. Cl.
*F41A 21/48* (2006.01)
*F41C 23/16* (2006.01)
*F41A 3/66* (2006.01)

(52) U.S. Cl.
CPC ..... *F41A 21/482* (2013.01); *F41A 3/66* (2013.01); *F41C 23/16* (2013.01)

(58) Field of Classification Search
CPC ..... F41C 23/16; F41A 21/48–21/488
See application file for complete search history.

(56) References Cited

U.S. PATENT DOCUMENTS 7,464,496 B1 12/2008 Davies et al.
8,347,540 B2 1/2013 Sirois
8,689,478 B2 4/2014 Patel
8,806,792 B2 * 8/2014 Yan ..... F41C 23/16 42/71.01
8,806,793 B2 8/2014 Daniel et al.
8,919,025 B2 12/2014 Kuczynko
D723,130 S 2/2015 Barrett
D734,828 S 7/2015 Geissele
9,140,506 B2 9/2015 Gomez
9,228,799 B2 1/2016 Kuczynko
9,234,717 B2 1/2016 Jarboe
9,303,949 B1 * 4/2016 Oglesby ..... F41C 23/16
9,464,865 B2 * 10/2016 Shea ..... F41C 23/16
2004/0049964 A1 3/2004 Vais
2007/0033851 A1 2/2007 Hochstrate et al.
2012/0017483 A1 1/2012 Vuksanovich
(Continued)

OTHER PUBLICATIONS

Bryce M. Towsley, Shooting Illustrated, Installing an AR-15 Barrel, May 24, 2011, pp. 1-3.*
(Continued)

*Primary Examiner* — Stephen M Johnson
*Assistant Examiner* — Joshua Semick
(74) *Attorney, Agent, or Firm* — ReavesColey PLLC

(57) ABSTRACT

An apparatus includes a barrel nut having an inner portion and an outer portion. The inner portion includes a threaded portion and a shoulder. The shoulder is configured to engage a shoulder of a barrel to retain the barrel within a receiver when the threaded portion is coupled to a corresponding threaded portion of the receiver. The outer portion defines an outer diameter such that a gas port of the receiver is exposed independent of a rotational position of the barrel nut relative to the receiver. The outer portion includes an engagement surface and a lock surface. The engagement surface is configured to engage a mounting surface of a handguard. The lock surface defines a frusto-conical shape configured to contact a set screw threadedly engaged with the handguard such that rotational movement of the set screw moves the handguard axially relative to the barrel nut.

24 Claims, 17 Drawing Sheets

(56) References Cited

U.S. PATENT DOCUMENTS

| | | | |
|---|---|---|---|
| 2014/0076152 | A1 | 3/2014 | Hochstrate et al. |
| 2014/0352191 | A1 | 12/2014 | Fritz et al. |
| 2016/0010937 | A1 | 1/2016 | Bero |
| 2016/0010938 | A1 | 1/2016 | Merkley et al. |

OTHER PUBLICATIONS

"New!! 2A Armamen LITE rails—KeyMod or M-LOK with Ti Nut," ar15news.com, Mar. 5, 2015 [online], [retrieved on Feb. 23, 2016] Retrieved from the Internet <URL: http://www.ar15news.com/2015/03/05/new-2a-armament-lite-rails-keymod-m-lok-ti-nut/>, 7 pages.

"BL-Rail KeyMod—2A Armament," 2a-arms.com [online], [retrieved Mar. 14, 2016] Retrieved from the Internet <URL: http://2a-arms.com/products/bi-rail-keymod?variant=4363694659>, 2 pages.

* cited by examiner

RIFLE BARREL NUT AND METHODS FOR COUPLING FIREARM COMPONENTS

BACKGROUND

The embodiments described herein relate to mechanisms for coupling firearm components, and more particularly to a rifle barrel nut for coupling a barrel and a handguard to a receiver of a firearm.

Known semi-automatic and automatic rifles operate under extreme conditions that can lead to significant wear in certain components, such as the rifle barrel. Additionally, it can be desirable to change the barrel configuration depending on the conditions under which the firearm will used. For example, shorter, lighter barrels are often used for close-quarters engagement, whereas longer, heavier barrels may be used in other situations (e.g., for improved accuracy when firing at greater distances). It can also be desirable to change the handguard, for example, to accommodate the user's preference for accessory mounting or for improved accuracy (e.g., by using a free-floating handguard). Accordingly, known semi-automatic and automatic rifles are configured to be repeatedly assembled and disassembled to accommodate changing the rifle barrel, the handguard, and other components.

Some known mechanisms for attachment of the rifle barrel and/or handguard, however, include a barrel nut that must be indexed with a gas port of the receiver or aligned with the gas tube that is coupled to the receiver. For example, some known barrel nuts used for an AR-15 rifle define a series of notches (or recesses) around the circumference of an outer flange. The notches are sized and/or shaped to receive a portion of the gas tube when the barrel is coupled to the receiver via the barrel nut. In certain instances, the notches can also be shaped to engage the mating lugs of a tool (or wrench) used to transfer torque to the nut during barrel installation. Thus, during the installation, such known barrel nuts are first tightened to a torque value within the specified torque range, for example 30 ft-lb (40.6 N-m). The wrench is then removed from the nut and the circumferential alignment is checked to verify whether one of the notches is aligned with the gas port. In fact, some known methods include using a separate alignment tool that simulates the positioning of the gas tube during rifle assembly to ensure proper alignment. If proper alignment is not achieved when the nut is initially tightened, the wrench is reapplied to the barrel nut, and the barrel nut is tightened incrementally until it is properly aligned.

Other known barrel nuts define a series of bores arranged circumferentially, and through which the gas tube passes. These barrel nuts nut must also be indexed (or circumferentially aligned) with the gas port of the receiver when the barrel is installed.

The iterative procedure used to align such known barrel nuts is time consuming and can result in misalignment that can negatively affect the performance of the rifle. Moreover, in certain instances, such known methods do not result in the desired alignment of the barrel nut within the torque specification. Specifically, in certain instances known barrel nuts can be tightened incrementally, as described above, up to the maximum torque value within the specified torque range (e.g., 80 ft-lb (108.3 N-m)), and still not be properly aligned. In such instances, additional assembly operations and parts, such as shims, may be needed to ensure proper alignment within the desired torque range of the nut.

Additionally, some known mechanisms for attachment of the rifle barrel and/or handguard include a barrel nut assembly that has multiple pieces. For example, some known barrel nut assemblies include a barrel nut and a spring-loaded delta ring. Such known designs are often referred to as "MIL-SPEC" designs, in reference to Military Specification MIL-C-71186 and other military specifications and standards that are related to the manufacture and assembly of these components. These known barrel nut assemblies allow for attachment of a two-piece (or split) handguard assembly. In addition to the issues identified with indexing (or circumferential alignment) discussed above, such known barrel nut assemblies also require that openings within the delta ring be aligned with the gas port. Moreover, methods of barrel and handguard assembly using such known assemblies include additional steps to assemble the barrel nut, delta ring, and spring.

Moreover, such known barrel nut assemblies do not accommodate mounting of a free-floating handguard. Similarly stated, such known barrel assemblies do not accommodate mounting a handguard only at the proximal (or receiver) end of the assembly, but rather require that the distal (or barrel) end of the handguard also be coupled to the rifle barrel.

In an effort to accommodate a free-floating handguard, some known barrel nuts include an outer diameter having mounting portions that receive a set screw or other fastener to secure the handguard thereto. Such known designs, however, require that the barrel nut be indexed (or circumferentially aligned) with the handguard to ensure that the handguard is properly aligned with the receiver, for example, to align the accessory rail portions of the receiver and handguard. Moreover, such known designs do not always ensure that the handguard is securely tightened against the receiver. For example, the use of some known barrel nuts can result in an undesirable gap between the receiver and the handguard (i.e., there is not a tight "lockup" between the receiver and the handguard).

Yet other known barrel nuts that accommodate a free-floating handguard require a series of steps to ensure proper axial alignment between a centerline of the barrel and a centerline of the handguard. For example, some known methods include sequentially and incrementally tightening the set screws when mounting the handguard to ensure that the handguard is axially aligned with the barrel.

Thus, a need exists for improved rifle barrel nuts for coupling a barrel and a handguard to a receiver without the need for time-consuming iterative alignment procedures, and that facilitates full engagement of the handguard to the receiver.

SUMMARY

Rifle barrel nuts for coupling a barrel and a handguard to a receiver are described herein. In some embodiments, an apparatus includes a barrel nut having an inner portion and an outer portion. The inner portion includes a threaded portion and a shoulder. The shoulder is configured to engage a shoulder of a barrel to retain the barrel within a receiver when the threaded portion is coupled to a corresponding threaded portion of the receiver. The outer portion defines an outer diameter such that a gas port of the receiver is exposed independent of a rotational position of the barrel nut relative to the receiver. The outer portion includes an engagement surface and a lock surface. The engagement surface is configured to engage a mounting surface of a handguard. The lock surface defines a frusto-conical shape configured to contact a set screw threadedly engaged with the handguard such that rotational movement of the set screw moves the handguard axially relative to the barrel nut.

DETAILED DESCRIPTION

Figure 1:
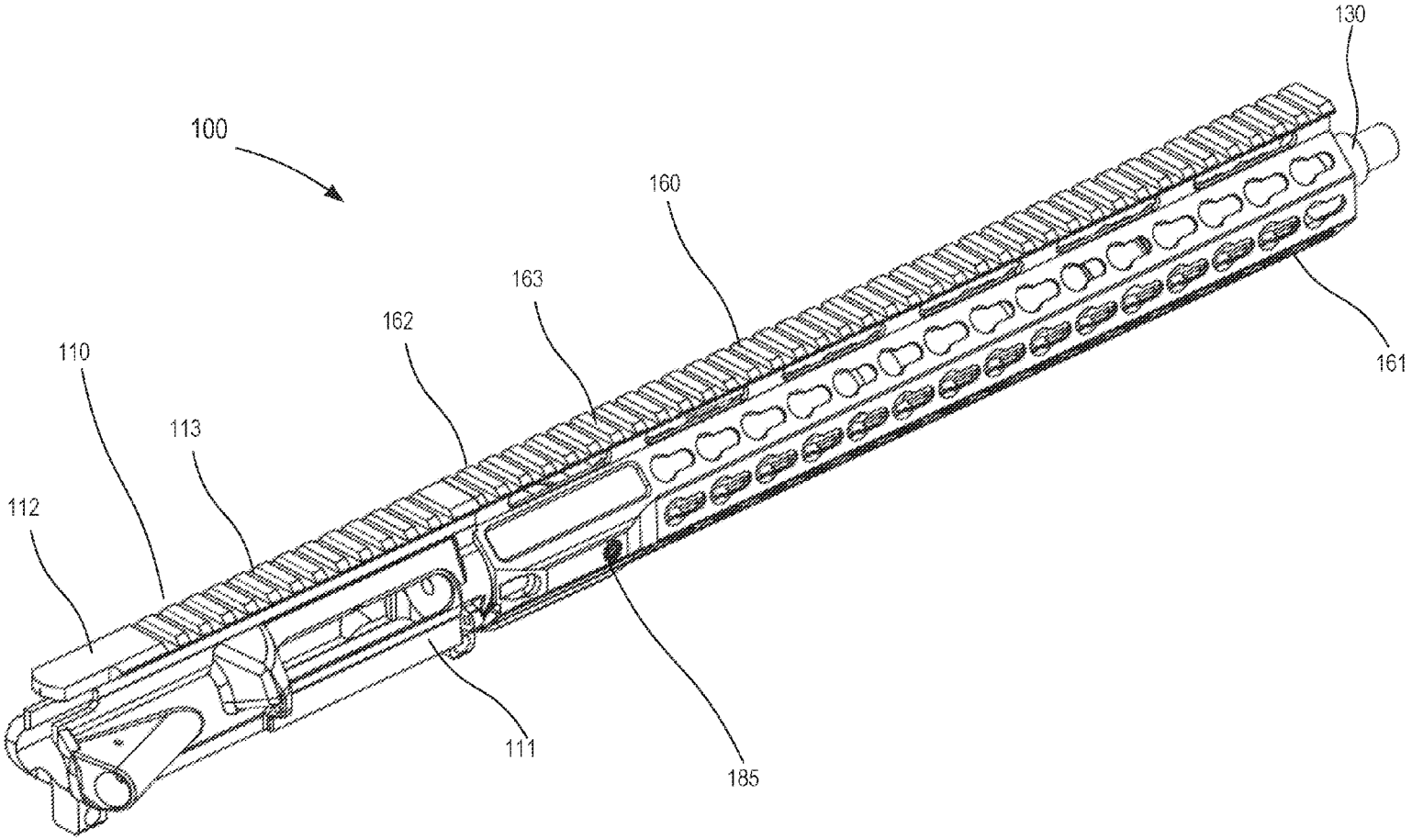
FIG. 1 is side perspective view of a firearm assembly according to an embodiment.

Rifle barrel nuts for coupling a barrel and a handguard to a receiver are described herein. In some embodiments, an apparatus includes a barrel nut having an inner portion and an outer portion. The inner portion includes a threaded portion and a shoulder. The shoulder is configured to engage a shoulder of a barrel to retain the barrel within a receiver when the threaded portion is coupled to a corresponding threaded portion of the receiver. The outer portion defines an outer diameter such that a gas port of the receiver is exposed independent of a rotational position of the barrel nut relative to the receiver. The outer portion includes an engagement surface and a lock surface. The engagement surface is configured to engage a mounting surface of a handguard. The lock surface defines a frusto-conical shape configured to contact a set screw threadedly engaged with the handguard such that rotational movement of the set screw moves the handguard axially relative to the barrel nut.

In some embodiments, an apparatus includes a handguard and barrel nut. The handguard includes a receiver engagement portion and a mounting surface. The receiver engagement portion is configured to engage an outer surface of a receiver to limit rotation of the handguard relative to the receiver. The mounting surface defines a cylindrical volume. The handguard defines a threaded bore. The barrel nut has an inner portion and an outer portion. The inner portion includes a threaded portion and a shoulder. The shoulder is configured to engage a shoulder of a barrel to retain the barrel within the receiver when the threaded portion is coupled to a corresponding threaded portion of the receiver. The outer portion includes an engagement surface and a lock surface. The engagement surface is configured to be disposed within the cylindrical volume and engage the mounting surface of the handguard. The lock surface defines a frusto-conical shape configured to contact a set screw threadedly engaged with the threaded bore of the handguard such that rotational movement of the set screw moves the handguard axially relative to the barrel nut.

In some embodiments, a method includes disposing an end portion of a barrel within an opening defined by a receiver. A barrel nut is rotated relative to the receiver to couple a threaded portion of the barrel nut to a corresponding threaded portion of the receiver. After the rotating, the barrel nut is tightened such that a shoulder of the barrel nut engages a shoulder of a barrel to retain the barrel within the receiver, the barrel nut being at a rotational position relative to the receiver after the tightening. The method further includes inserting, without adjusting the rotational position of the barrel nut relative to the receiver, at least one of a gas tube or a rod into a port of the receiver. An end portion of a handguard is disposed about an outer engagement surface of the barrel nut such that the handguard covers the barrel and the gas tube or the rod. After the disposing the end portion of the handguard, a set screw is tightened within a threaded bore defined by the handguard such that an end surface of the set screw contacts a lock surface of the barrel nut, causing the handguard to move axially into engagement with the receiver.

The term "about" when used in connection with a referenced numeric indication means the referenced numeric indication plus or minus up to 10 percent of that referenced numeric indication. For example, "about 100" means from 90 to 110.

As used in this specification and the appended claims, the words "proximal" and "distal" refer to direction closer to and away from, respectively, an operator of the firearm. Thus, for example, the end of the firearm or firearm component nearest the operator during a firing operation would be the proximal end of the component, while the end opposite the proximal end would be the distal end of the component. For example, a proximal end of a rifle barrel would be the end portion that is coupled to the receiver, and the distal end would be end out of which the ammunition is expelled.

The term "parallel" is used herein to describe a relationship between two geometric constructions (e.g., two lines, two planes, a line and a plane, or the like) in which the two geometric constructions are non-intersecting as they extend substantially to infinity. For example, as used herein, a planar surface (i.e., a two-dimensional surface) is said to be parallel to a line when every point along the line is spaced apart from the nearest portion of the surface by a substantially equal distance. Similarly, a first line (or axis) is said to be parallel to a second line (or axis) when the first line and the second line do not intersect as they extend to infinity. Two geometric constructions are described herein as being "parallel" or "substantially parallel" to each other when they are nominally parallel to each other, such as for example, when they are parallel to each other within a tolerance. Such tolerances can include, for example, manufacturing tolerances, measurement tolerances or the like.

The terms "perpendicular," "orthogonal," and "normal" are used herein to describe a relationship between two geometric constructions (e.g., two lines, two planes, a line and a plane, or the like) in which the two geometric constructions intersect at an angle of approximately 90 degrees within at least one plane. For example, as used herein, a line (or axis) is said to be normal to a planar surface when the line and a portion of the planar surface intersect at an angle of approximately 90 degrees within the planar surface. Two geometric constructions are described herein as being, for example, "perpendicular" or "substantially perpendicular" to each other when they are nominally perpendicular to each other, such as for example, when they are perpendicular to each other within a tolerance. Such tolerances can include, for example, manufacturing tolerances, measurement tolerances or the like.

Similarly, geometric terms, such as "parallel," "perpendicular," "cylindrical," "square," "conical," or "frusto-conical" are not intended to require absolute mathematical precision, unless the context indicates otherwise. Instead, such geometric terms allow for variations due to manufacturing or equivalent functions. For example, if an element is described as "conical" or "generally conical," a component that is not precisely conical (e.g., one that is slightly oblong) is still encompassed by this description.

Figure 2:
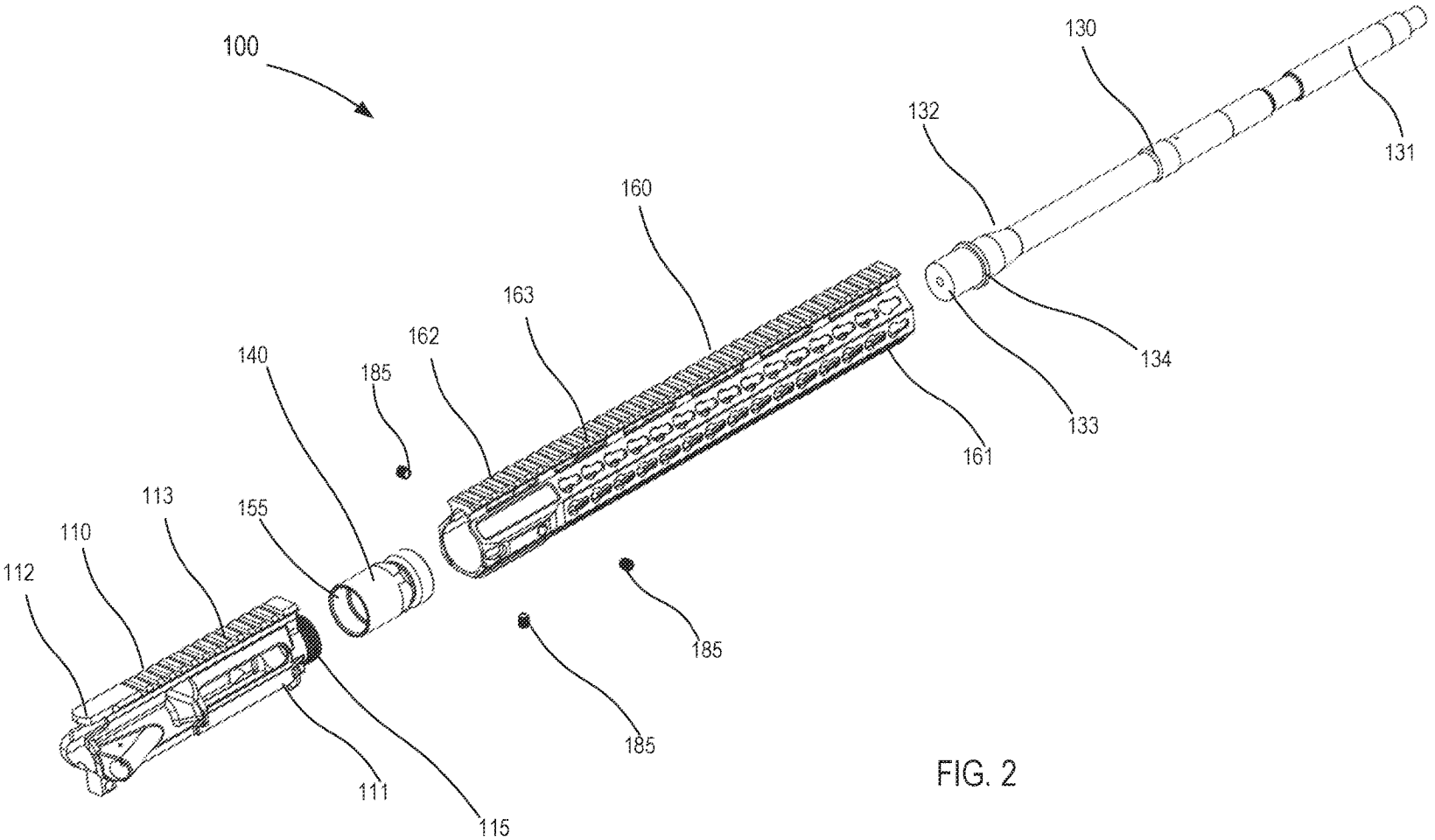
FIG. 2 is an exploded view of the firearm assembly shown in FIG. 1.

FIGS. 1-19 show a portion of a firearm assembly 100, according to an embodiment. Specifically, FIGS. 1 and 2 are perspective views of the firearm assembly 100, and FIGS. 3-11 show certain components, such as the barrel nut 140, that are included within the firearm assembly 100. FIGS. 12-19 show the firearm assembly 100 in various different configurations (or stages) during of assembly. The firearm assembly 100 can be any suitable semi-automatic or automatic rifle that directs gas from the barrel to extract the empty cartridge from the receiver. Thus, although FIGS. 1-19 show components of an AR-15 rifle, the components and methods described herein (including the barrel nuts, handguards, and methods of assembly) can be used in connection with any suitable firearm. For example, the components and methods described herein (including the barrel nuts, handguards, and methods of assembly) can be used in connection with an M-16 rifle, M4 rifle, AR-15 aftermarket variants marketed under manufacturer unique model number, AR-10 rifle, SR-25 rifle, LMT MWS, LR-308, LAR-8 M110, or any other rifle which utilizes a barrel not threaded directly to the receiver.

As shown in FIGS. 1 and 2, the firearm assembly 100 includes an upper receiver 110, a rifle barrel 130, a barrel nut 140 and a handguard 160. The upper receiver 110, which is also referred to as simply a "receiver," can be part of a firearm receiver assembly, and can contain a firing mechanism and related components, such as those used in an AR-15 rifle. The firing mechanism (not shown) can include, for example, a spring-biased hammer, a firing pin, a bolt assembly, and certain gas transfer components. After firing, the gas transfer components meter a portion of the combustion gases within the barrel back into the receiver 110 to drive the bolt rearward against a recoil spring. In this manner, the firearm assembly 100 can automatically eject a spent cartridge casing and automatically load a new cartridge into the chamber from the magazine.

Figure 3:
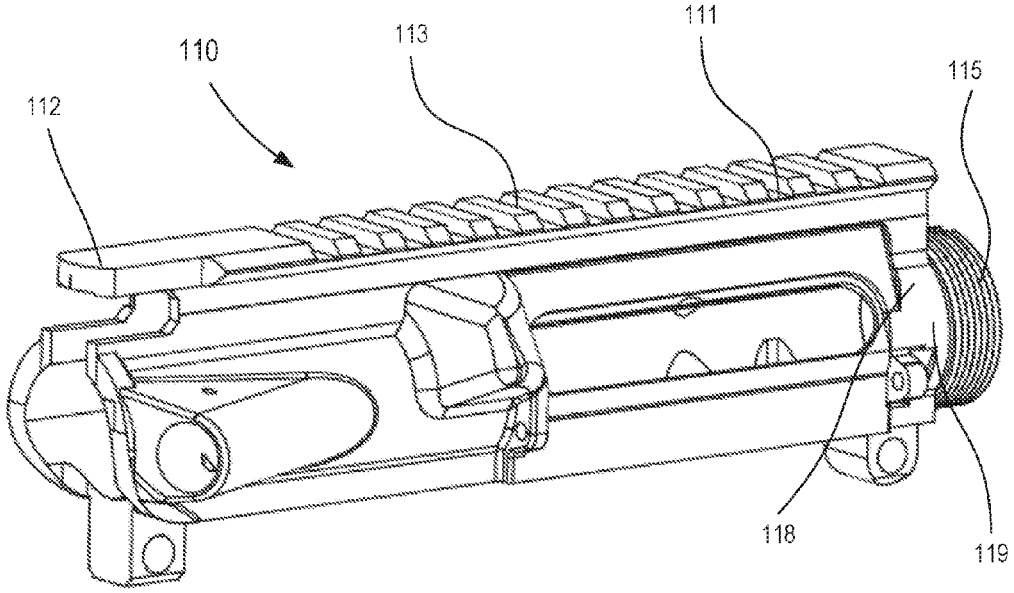
FIGS. 3 and 4 are a side perspective view and a front view, respectively, of a receiver included in the firearm assembly shown in FIG. 1.
Figure 4:
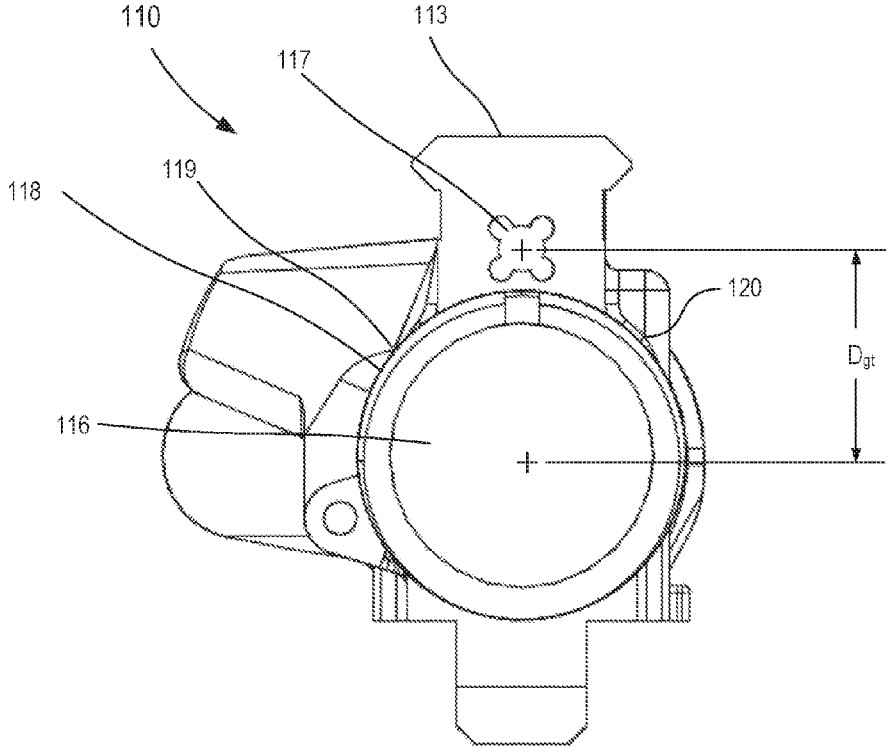

As shown in FIGS. 3 and 4, the upper receiver 110 includes a proximal end portion 112 and a distal end portion 111. The top portion of the upper receiver 110 includes an accessory rail 113, such as a Picatinny rail. The accessory rail 113 includes a series of flat protrusions to which accessories can be mounted. As shown in FIG. 1, the distal-most portion of the accessory rail 113 engages the proximal-most portion of the accessory rail 163 of the handguard 160 to form a continuous accessory rail.

The distal (or "barrel") end portion 111 of the upper receiver 110 includes an outer surface 118 and a threaded portion 115. The threaded portion 115 includes male threads that correspond to the female threads 155 of the barrel nut 140, as described below. The outer surface 118 includes a first side 119 and a second side 120, one on either side of the accessory rail 113. As described below, the first side 119 and the second side 120 engage an engagement (or "lock up") portion 167 of the handguard 160 to facilitate the secure coupling of the handguard 160 to the upper receiver 110.

As shown in FIG. 4, the distal end portion 111 of the upper receiver 110 defines a barrel opening 116 and a gas port 117. The barrel opening 116 receives a mounting portion 133 of the barrel 130 during assembly (see, e.g., FIG. 12). The gas port 117 receives a portion of a gas tube (not shown). The gas tube provides a fluidic coupling between a gas port on the barrel 130 and the upper receiver 110 to allow a portion of the combustion gas to flow from the barrel to the upper receiver 110 to facilitate the automatic ejection of and/or automatic loading of cartridges during operation. This system can be referred to as a "gas direct" or "direct impingement" mechanism, because the gas returned via the gas tube exerts a pressure directly on the bolt and/or bolt carrier (not shown). As shown in FIG. 4, a center line of the gas port 117 is spaced apart from a center line of barrel opening 116 by a distance $D_{gt}$. In some embodiments, the gas port 117 can receive a rod or other mechanical link that transmits a force produced by gas pressure back to the receiver. Such systems can be referred to as a "gas cylinder" mechanism.

Figure 5:
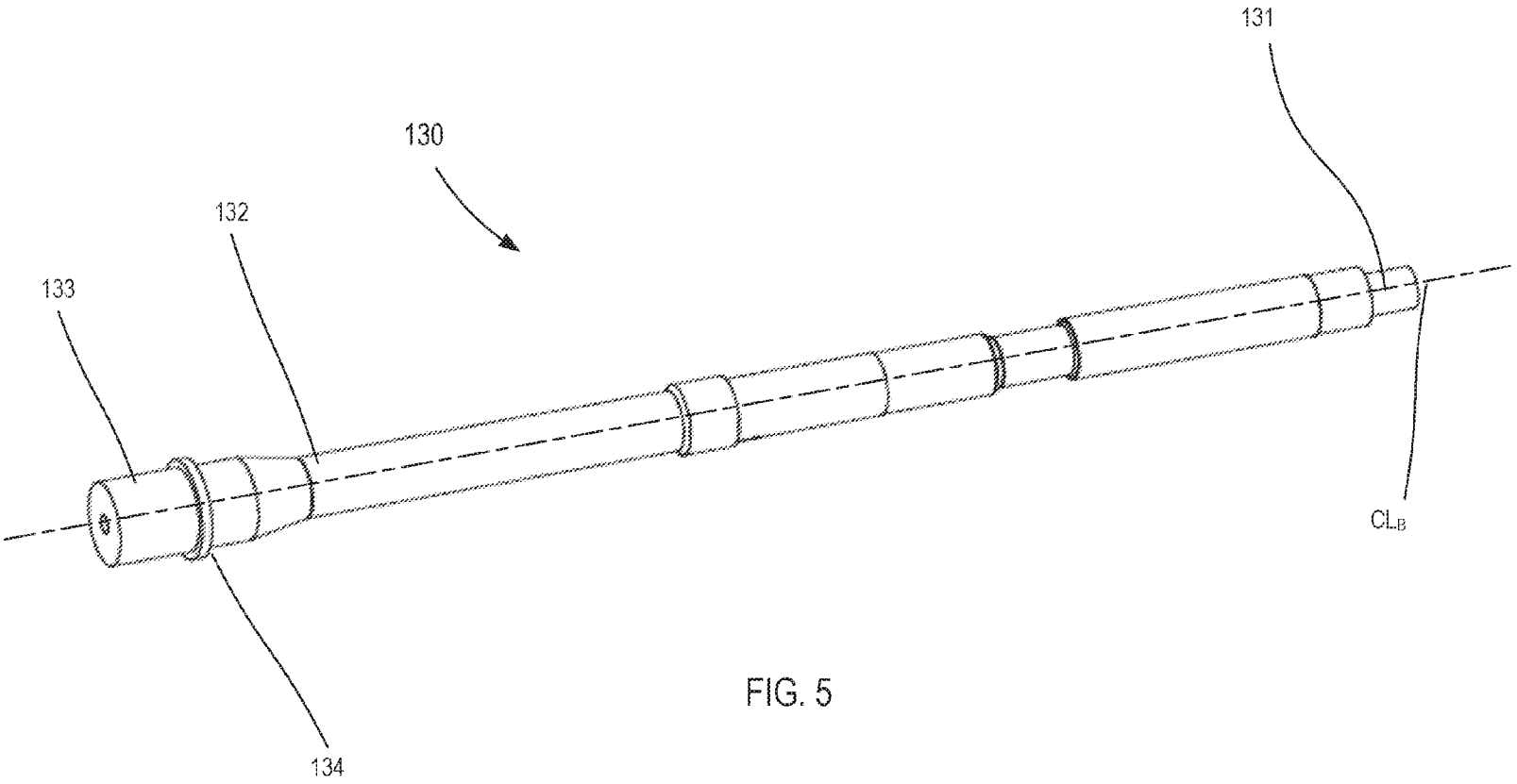
FIG. 5 is a side perspective view of a barrel included in the firearm assembly shown in FIG. 1.

As shown in FIG. 5, the barrel 130 includes a proximal end portion 132 and a distal end portion 121, and defines a longitudinal center line $CL_B$. The proximal end portion 132 of the barrel 130 includes a mounting portion 133, which is disposed within the barrel opening 116 when the firearm 100 is assembled. The proximal end portion 132 also includes a shoulder 134 that contacts an internal shoulder 156 of the barrel nut 140 (see, e.g., FIGS. 6 and 7) such that the barrel nut 140 can secure the mounting portion 133 within the upper receiver 110 when the barrel nut 140 is tightened.

The barrel 130 can be any suitable barrel for use with the firearm assembly 100. For example, in some embodiments, the barrel 130 can have a length of 177.8 mm (7 inches), 228.6 mm (9 inches), 254 mm (10 inches), 266.7 mm (10.5 inches), 279.4 mm (11 inches), 368.3 mm (14.5 inches), 406.4 mm (16 inches), 419.1 mm (16.5 inches), 457.2 mm (18 inches), 508 mm (20 inches), 609.6 mm (24 inches). The barrel 130 can accommodate any suitable profiles and calibers, including variations that do not require a gas system for operation, such as any of the 9 mm blow back operated platforms. Moreover, in some embodiments, the barrel 130 can be an assembly that includes a barrel and a barrel extension coupled together to form the proximal end portion 132 of the barrel 130. In such embodiments, the barrel extension can be threadedly coupled to the barrel, and can include the mounting portion 133 and/or the shoulder 134. In other embodiments, however, the barrel 130 can be monolithically constructed.

Figure 6:
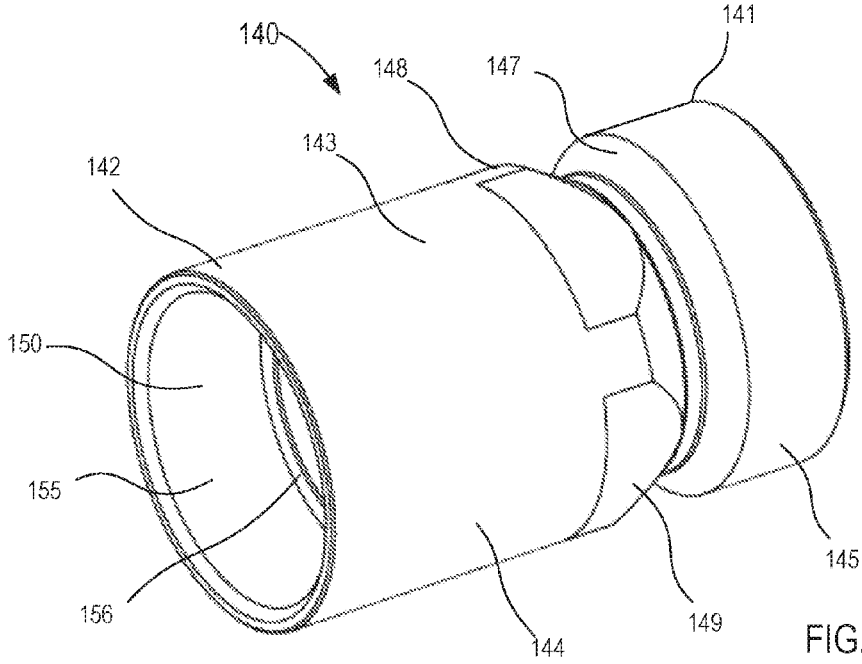
FIGS. 6 and 7 are a side perspective view and a cross-sectional view, respectively, of a barrel nut according to an embodiment included in the firearm assembly shown in FIG. 1.
Figure 7:
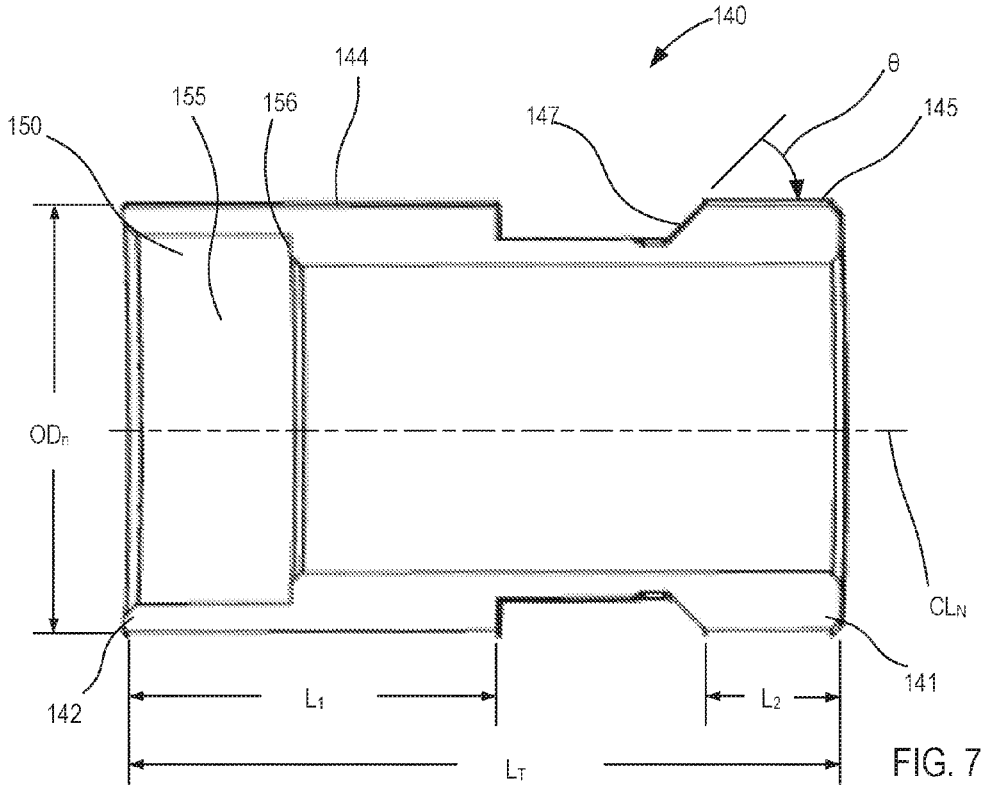
Figure 8:
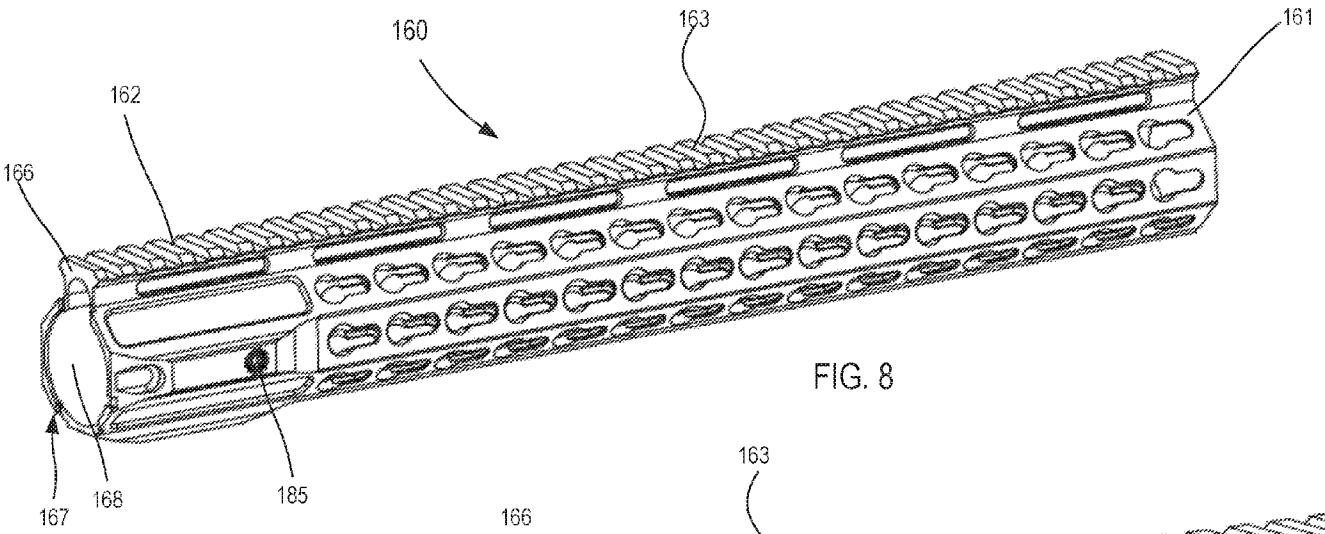
FIGS. 8 and 9 are a side perspective views of a handguard according to an embodiment included in the firearm assembly shown in FIG. 1.
Figure 9:
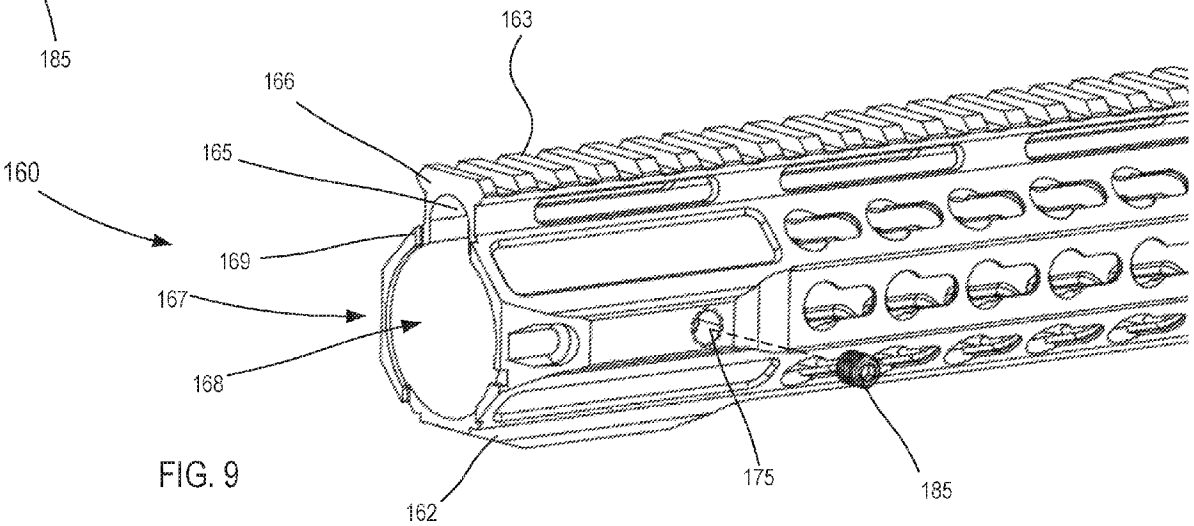
Figure 10:
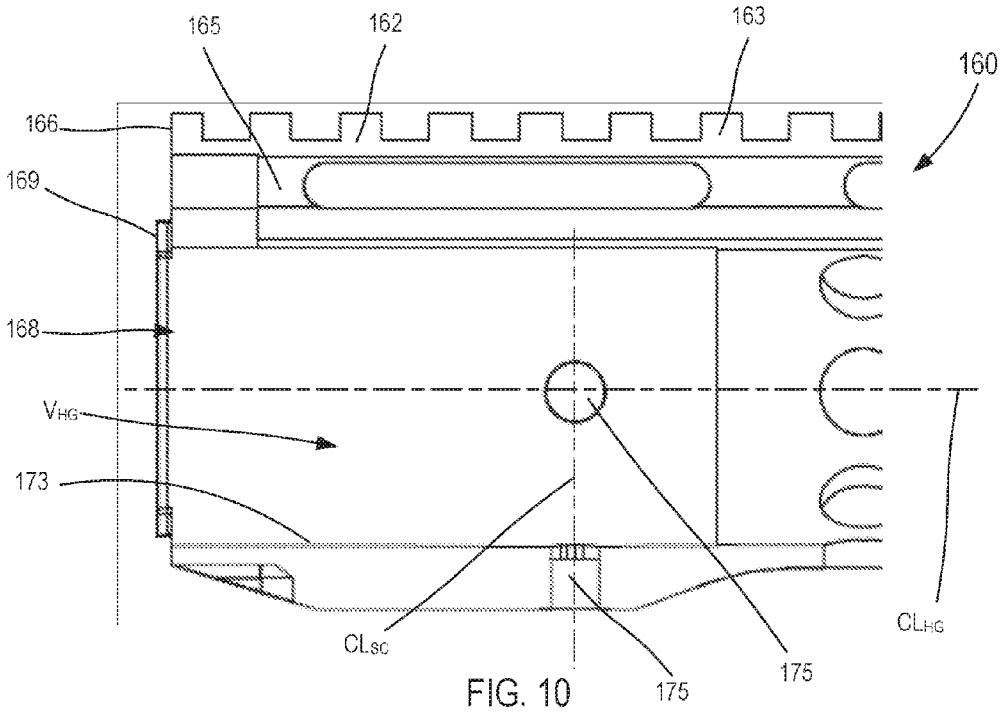
FIG. 10 is a side cross-sectional view of the handguard shown in FIGS. 8 and 9.
Figure 11:
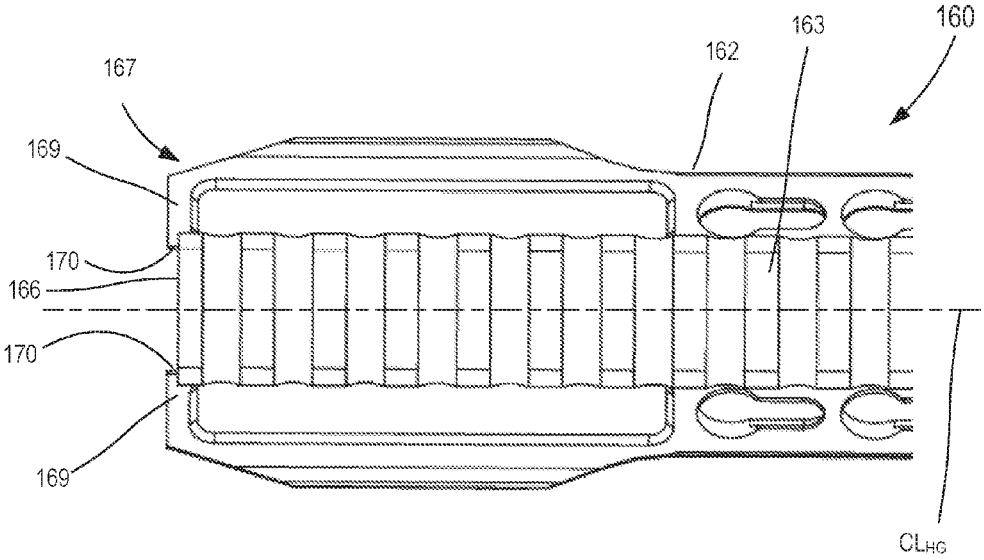
FIG. 11 is a top view of the handguard shown in FIGS. 8 and 9.

The barrel 130 is coupled to the upper receiver 110 by the barrel nut 140. As described herein, the barrel nut 130 also couples the handguard 160 to the firearm assembly 100. As shown in FIGS. 6 and 7, the barrel nut 140 includes a proximal (or receiver) end portion 142 and a distal (or barrel) end portion 141. The barrel nut 140 also includes an outer portion 143 and an inner portion 150. The inner portion 150 includes a threaded portion 155 and a shoulder 156, and defines a bore within which the barrel 130 can be disposed. Said another way, the barrel nut 140 can be disposed about the barrel 130 to couple the barrel 130 to the upper receiver 110 (see FIGS. 12 and 13). More specifically, the threaded portion 155 is at the proximal end portion 142, and includes threads (not shown) that correspond to and/or are matingly engaged with the threaded portion 115 of the upper receiver 110. The shoulder 156 is sized to engage the shoulder 134 of the barrel. In this manner, when the barrel nut 140 is tightened onto the upper receiver 110, the shoulder 156 engages the barrel shoulder 134 to retain the barrel 130 within the upper receiver 110.

The outer portion 143 of the barrel nut 140 includes a tool engagement portion 148 that defines a series of flats 149. The flats are sized and configured such that a wrench or other tool can engage the outer portion 143 of the barrel nut 140 to tighten the barrel nut 140 onto the upper receiver 110. Said another way, the tool engagement portion 148 is configured to engage a mating portion of a tool (or wrench) used to transfer torque to the barrel nut 140 during barrel installation. In some embodiments, for example, the flats 149 can be spaced for engagement with a 1⅛" wrench. In other embodiments, the tool engagement portion 148 can be configured to engage any suitable tool of any suitable size, such as the MIL-SPEC barrel nut wrench, a spanner wrench, adjustable wrench, strap wrench, and unique regular or irregular interface shapes.

The outer portion 143 of the barrel nut 140 also includes a first engagement surface 144, a second engagement surface 145 and a lock surface 147. As described below, the first engagement surface 144 and the second engagement surface 145 are sized and configured to engage the mounting surface 173 of the handguard 160 (see FIGS. 10 and 18). More specifically, the first engagement surface 144 is a cylindrical surface having a length $L_1$ and the second engagement surface 145 is a cylindrical surface having a length $L_2$. Thus, when the handguard 160 is disposed about and/or engaged with the barrel nut 140, the total length of engagement between the mounting surface 173 of the handguard 160 and the outer portion 143 of the barrel nut 140 extends from the proximal-most end of the first engagement surface 144 to the distal-most end of the second engagement surface 145. This is shown in FIG. 7 by the length $L_T$.

Figure 17:
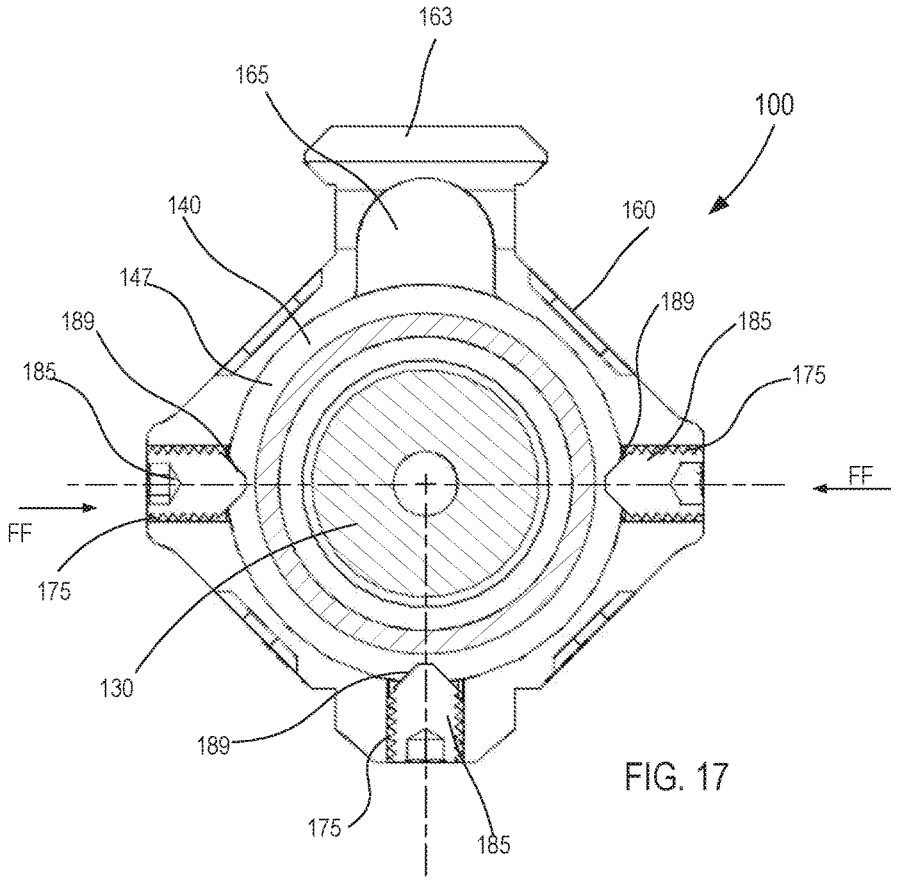
FIGS. 17 and 18 are front cross-sectional view and a side cross-sectional view, respectively, of the portion of the firearm assembly shown in FIG. 1 in the fourth configuration.
Figure 18:
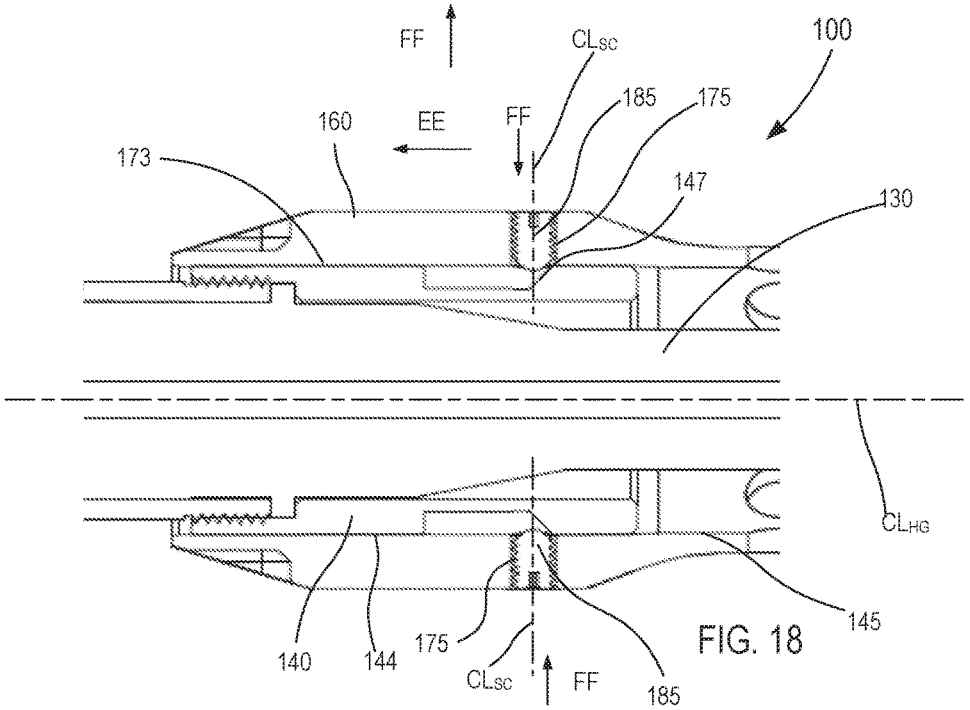

The lock surface 147 of the barrel nut 140 is disposed between the first engagement surface 144 and the second engagement surface 145, and defines a frusto-conical shape that contacts a set screw 185 of the handguard 160. More specifically, as shown in FIGS. 17 and 18, the set screw 185 can be one of a series of set screws that is threadedly engaged with the handguard 160 such that when the set screw 185 is tightened, the tip of the set screw contacts the lock surface 147. The frusto-conical shape of the lock surface 147 is such that further tightening of the set screw 185 moves the handguard 160 axially (i.e., along the center line $CL_{HG}$ of the handguard) to engage the upper receiver 110. Similarly stated, the lock surface 147 is shaped such that rotational movement of the set screw 185 moves the handguard 160 axially relative and/or about to the barrel nut 140.

The lock surface 147 can have any suitable conical or frusto-conical shape that forms a non-zero angle θ with the center line $CL_N$ of the barrel nut 140, the first engagement surface 144, and or the second engagement surface 145. For example, as shown, the lock surface forms an acute angle θ with the second engagement surface 145. Because the lock surface 147 is at an acute angle with respect to the second engagement surface 145, a component of the force transmitted when the set screw 185 is tightened (shown by the arrow FF in FIG. 18) is along the center line $CL_N$ of the handguard, thus causing axial movement of the handguard 160. In some embodiments, the lock surface 147 can define an angle θ of about 45 degrees. In other embodiments, the lock surface 147 can define an angle θ of between about 30 degrees and about 60 degrees. Moreover, as shown in FIG. 17, in some embodiments, the tip 189 of the set screw 185 can also form an angle that is about the same as the lock surface angle θ. In this manner, the surface area of engagement between the tip 189 of the set screw 185 and the lock surface 147 can be maximized (as compared to that of a flatted-end set screw).

Referring again to FIG. 7, the outer portion 143 of the barrel nut 140 (including the first engagement surface 144 and/or the second engagement portion 145) defines an outer diameter $OD_n$. The outer diameter $OD_n$ is sized such that when the barrel nut 140 is tightened to the upper receiver 110, the gas port 117 is exposed independent of a rotational position of the barrel nut 140 relative to the receiver 110 (see e.g., FIG. 13). Said another way, the radius $OD_n$ of the barrel nut 140 (half of the $OD_n$) is less than the distance $D_{gt}$ between the center line of the gas port 117 and the center line of barrel opening 116. In this manner, the barrel nut 140 can be tightened about the receiver 110 without being indexed and/or circumferentially aligned to allow the gas tube or a rod (not shown) to be connected to the gas port 117, as described in more detail below.

Figure 16:
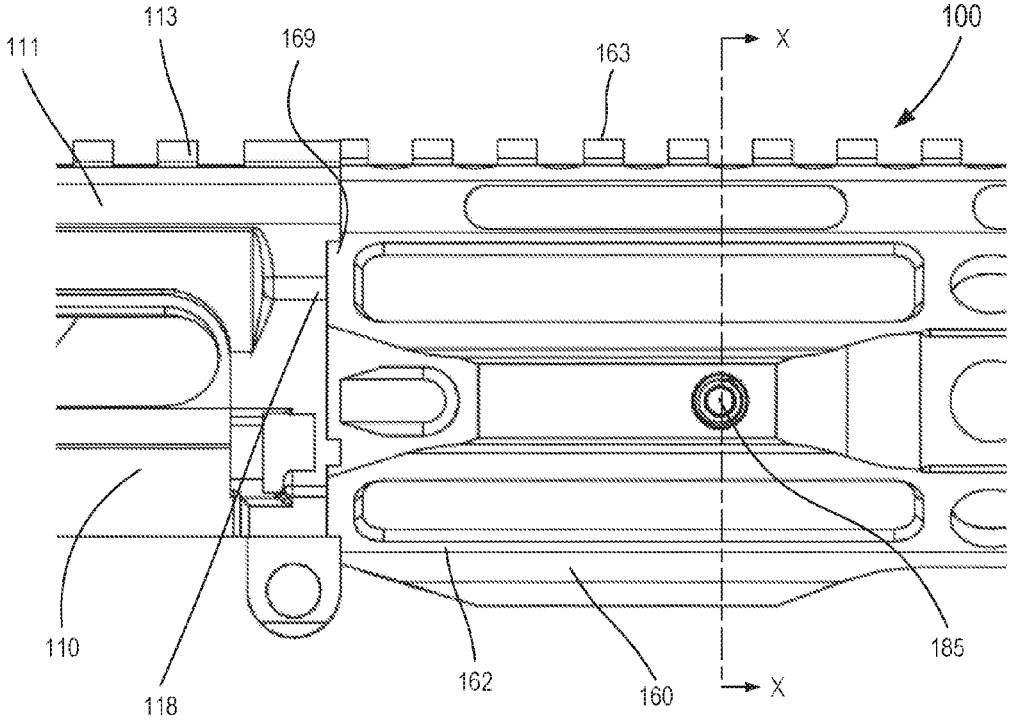

As shown in FIGS. 8-11, the handguard 160 includes a proximal (or receiver) end portion 162 and a distal (or barrel) end portion 161, and defines a longitudinal center line $CL_{HG}$. The top portion of the handguard 160 includes an accessory rail 163, such as a Picatinny rail. The accessory rail 163 includes a series of flat protrusions to which accessories can be mounted. As shown in FIGS. 1 and 16, the proximal-most portion of the accessory rail 163 of the handguard 160 engages the distal-most portion of the accessory rail 113 of the upper receiver 110 to form a continuous accessory rail. Specifically, the proximal end portion 162 includes a receiver engagement (or lock-up) portion 167 that includes an engagement surface 166 and a pair of protrusions 169. When the handguard 160 is coupled to the upper receiver 110, the engagement surface 166 is in contact with the corresponding surface of the upper receiver 110 such that the handguard 160 abuts the upper receiver 110. Similarly stated, when the handguard 160 is coupled to the upper receiver 110, the engagement surface 166 is in contact with the corresponding surface of the upper receiver 110 such that the accessory rail 163 and the accessory rail 113 form a continuous rail that is substantially free of gaps or spaces.

Additionally, the protrusions (or anti-rotation lugs) 169 contact the upper receiver 110 on both sides of the accessory rail 113 to limit rotation of the handguard 160 relative to the upper receiver 110. Specifically, one of the protrusions 169 contacts the first side 119 of the outer surface 118 of the upper receiver 110 and the other protrusion 169 contacts the second side 120 of the outer surface 118 of the upper receiver 110. The contact between the surface 170 of the first protrusion and the first side 119 and the surface 170 of the second protrusion and the second side 120 limits rotation of the handguard 160 relative to the upper receiver 110. In some embodiments, the surface 170 of each protrusion 169 can be tapered to facilitate engagement with the first side 119 and the second side 120 during assembly of the handguard 160 to the upper receiver 110. For example, in some embodiments, the included angle between the surface 170 of the first protrusion and the surface 170 of the second protrusion can be about 10 degrees. In other embodiments, the included angle between the surface 170 of the first protrusion and the surface 170 of the second protrusion can be between about five degrees and about 15 degrees. In yet other embodiments, the included angle between the surface 170 of the first protrusion and the surface 170 of the second protrusion can be less than about 25 degrees.

The proximal end portion 162 of the handguard 160 defines a gas tube (or rod) passage 165 and a barrel opening 168. The gas tube passage 165 is beneath the accessory rail 163, and is aligned with the gas port 117 when the handguard 160 is coupled to the upper receiver 110. The gas tube passage 165 receives a gas tube or rod (not shown) coupled between the barrel 130 and the upper receiver 110. The barrel opening 168 opens into an inner volume $V_{HG}$ of the handguard 160 that receives the barrel 130 and the barrel nut 140 therein when the handguard 160 is coupled to the upper receiver 110. The handguard 160 includes a mounting surface 173 that defines at least a portion of a boundary of the inner volume $V_{HG}$. Specifically, the inner volume $V_{HG}$ is a substantially cylindrical volume that corresponds to a shape of the barrel nut 140 to facilitate coupling of the handguard 160 to the barrel nut 140. As shown in FIG. 18, at least one of the first engagement surface 144 or the second engagement surface 145 of the barrel nut 140 engages the internal mounting surface 173 to couple the handguard 160 to (and about) the barrel nut 140. As described in more detail below, the mounting surface 173 has a length that accommodates the total length $L_T$ of engagement between the handguard and the barrel nut 140.

The handguard defines a series of set screw bores 175 within which the set screws 185 are threadedly engaged. As shown, for example, in FIG. 10, the set screw bores 175 define a set screw centerline $CL_{SC}$ along which the set screws 185 translate when they are rotated within the set screw bores 175. In this manner, when the set screw 185 is tightened, the tip 189 of the set screw moves along the set screw centerline $CL_{SC}$ and contacts the lock surface 147. As shown in FIG. 18, the set screw centerline $CL_{SC}$ is substantially normal to the axial center line of the handguard $CL_{HG}$. This arrangement produces the maximum flush contact between the lock surface 147 and the tip of the set screw 185. In other embodiments, however, the set screw centerline $CL_{SC}$ and the axial center line of the handguard $CL_{HG}$ can define any suitable angle. For example, in some embodiments, the set screw centerline $CL_{SC}$ and the axial center line of the handguard $CL_{HG}$ define and angle between about 75 degrees and about 105 degrees. In other embodiments, the set screw centerline $CL_{SC}$ and the axial center line of the handguard $CL_{HG}$ define and angle between about 60 degrees and about 120 degrees.

Figure 12:
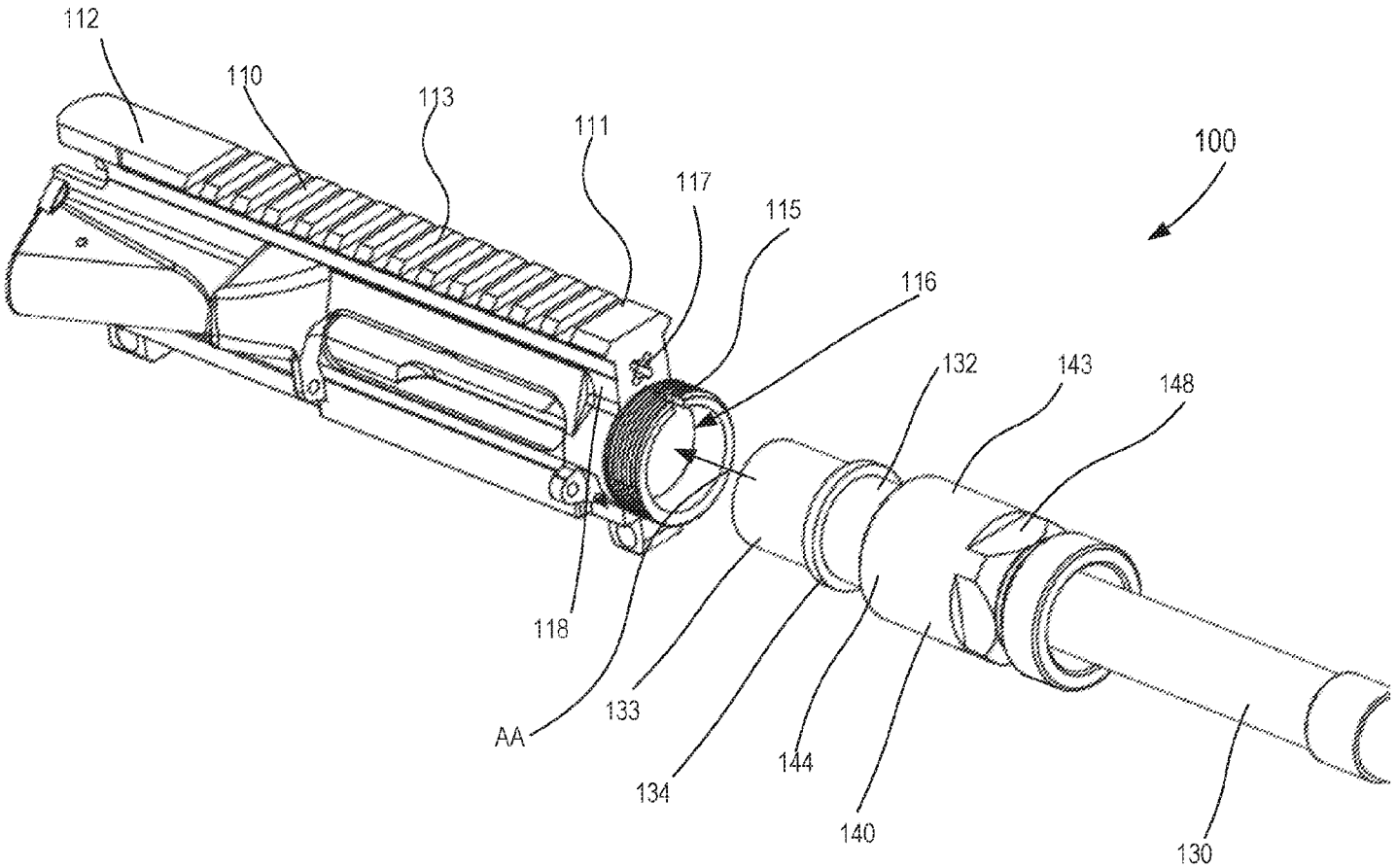
FIGS. 12 and 13 are side perspective views of a portion of the firearm assembly shown in FIG. 1 in a first configuration and a second configuration, respectively.

FIGS. 12-16 show the firearm assembly 100 in various stages (or configurations) of assembly. FIG. 12 shows the firearm assembly 100 in a first configuration in which the barrel 130 positioned prior to being attached to the upper receiver 110. During assembly, the mounting portion 133 of the barrel is disposed within the barrel opening 116, as shown by the arrow AA. The barrel nut 140 is disposed about the barrel 130 such that the internal shoulder 156 of the barrel nut 140 can be moved into contact with the barrel shoulder 134.

After the mounting portion 133 of the barrel 130 is disposed within the upper receiver 110, the barrel nut 140 is threaded onto the upper receiver 110, thereby placing the firearm assembly 100 in a second configuration. More particularly, the barrel nut 140 is rotated, as shown by the arrow BB in FIG. 13, such that the female threaded portion 155 of the barrel nut 140 is threadedly engaged with the male threaded portion 115 of the upper receiver 110. The barrel nut 140 can then be tightened by further rotating the barrel nut 140 about the upper receiver 110 to secure the barrel 130 to the upper receiver 110. In particular, a tool (not shown) can be coupled to the tool engagement portion 148, and the tool can be used to transfer torque to the barrel nut 140. In some embodiments, the tool can be a torque wrench used to apply a predetermined amount of torque to the barrel nut 140. Specifically, in some embodiments, the barrel nut 140 can be tightened to a torque value within the range of 30 ft-lb (40.6 N-m) to 80 ft-lb (108.3 N-m).

Figure 13:
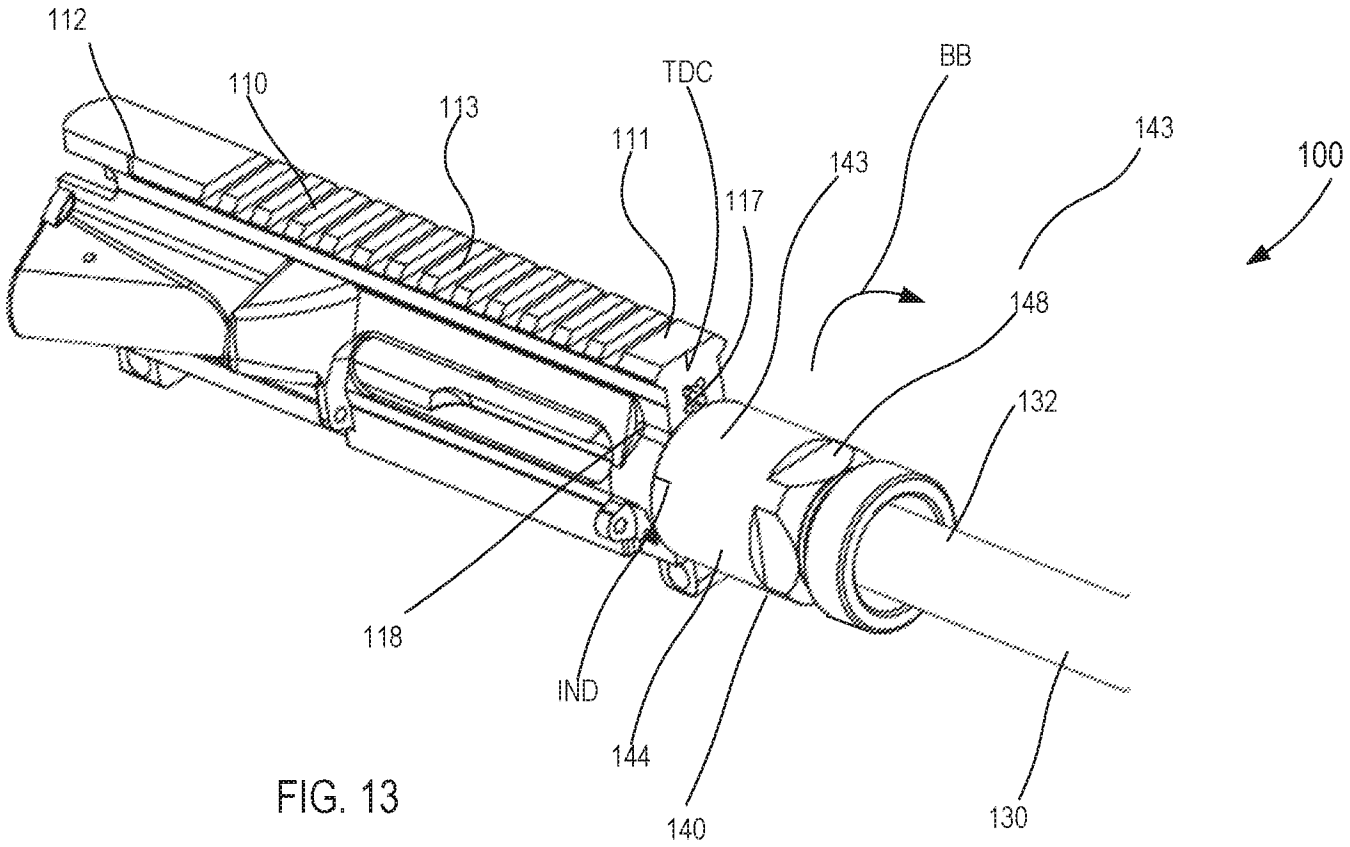
Figure 14:
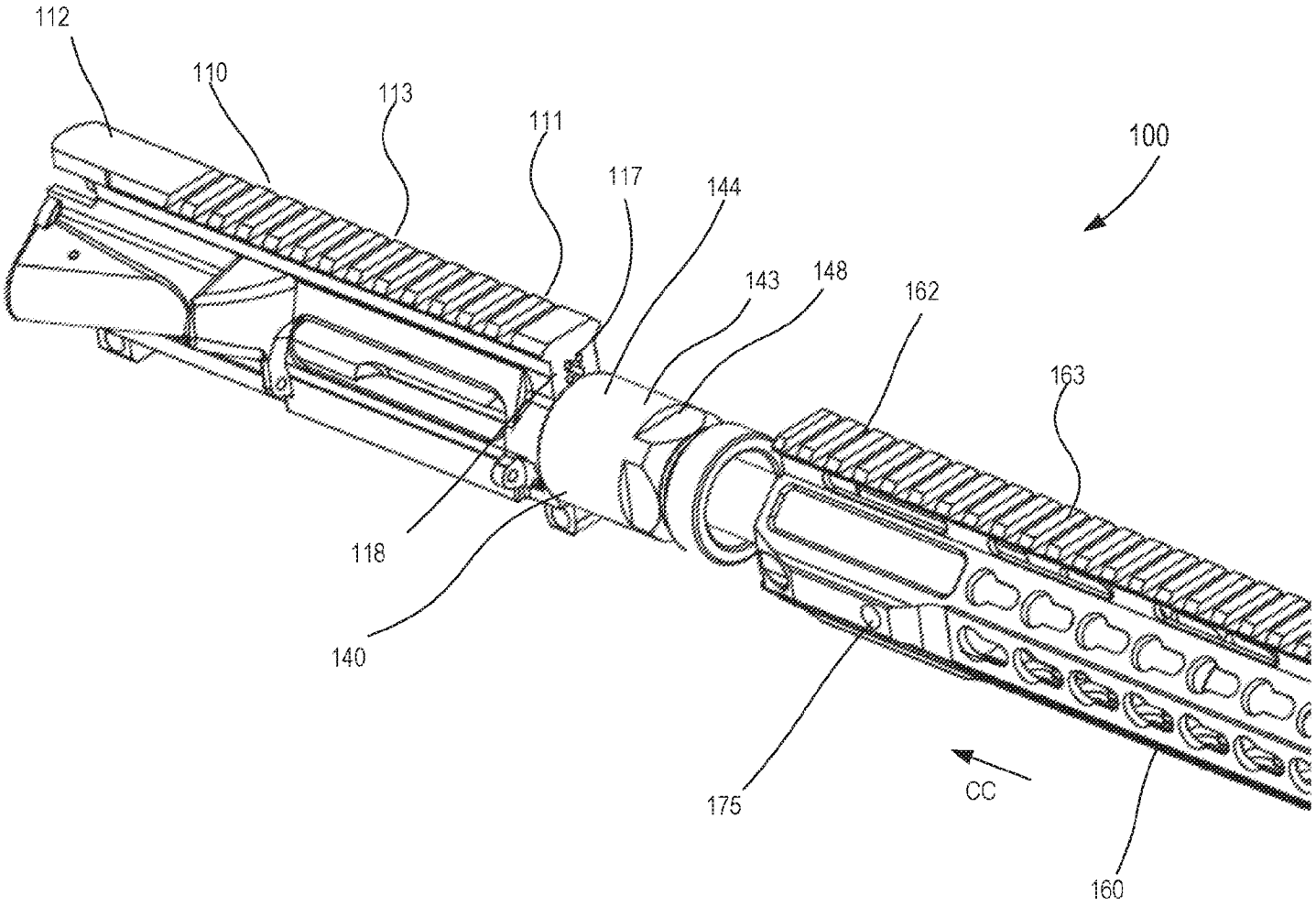
FIG. 14 is a side perspective view of the portion of the firearm assembly shown in FIG. 1 in a third configuration.

After the barrel nut 140 is tightened, it is at a rotational position relative to the upper receiver 110. Similarly stated, the angular orientation of a particular location (indicated by the mark "IND" in FIG. 13) on the outer portion 143 of the barrel nut 140 relative to top center portion (indicated by the mark "TDC" in FIG. 13) of the upper receiver 110 is between 0 and 360 degrees after the barrel nut 140 is tightened. As shown in FIG. 13, the barrel nut 140 is configured such that the gas port 117 is exposed independent of the rotational position of the barrel nut. Said another way, the outer diameter $OD_n$ is sized such that when the barrel nut 140 is tightened to the upper receiver 110, the gas port 117 is exposed independent of the rotational position. This arrangement allows the barrel nut 140 to be tightened in a single operation without the need to index and/or circumferentially align any portion of the barrel nut 140 to the upper receiver 110 to accommodate the installation of the gas tube or the rod (not shown). This arrangement also allows the barrel nut 140 to be tightened to within a narrower torque range (e.g., between 50 ft-lb and 60 ft-lb), thus producing a consistent preload.

Because the gas port 117 is exposed independent of the rotational position of the barrel nut 140, the gas tube or rod (not shown) can be installed between the barrel 130 and the upper receiver 117. The firearm assembly 100 can be moved from the second configuration (FIG. 13) to a third configuration (FIG. 14) by disposing the handguard 160 about the barrel 130, and moving the handguard 160 into position about the barrel nut 140 as shown by the arrow CC in FIG. 14. The handguard 160 is moved such that the first engagement surface 144 and the second engagement surface 145 contact and/or engage the internal mounting surface 173 of the handguard 160. In this manner, the barrel nut 140 facilitates the coupling of both the barrel 130 and the handguard 160 to the upper receiver 110.

Figure 15:
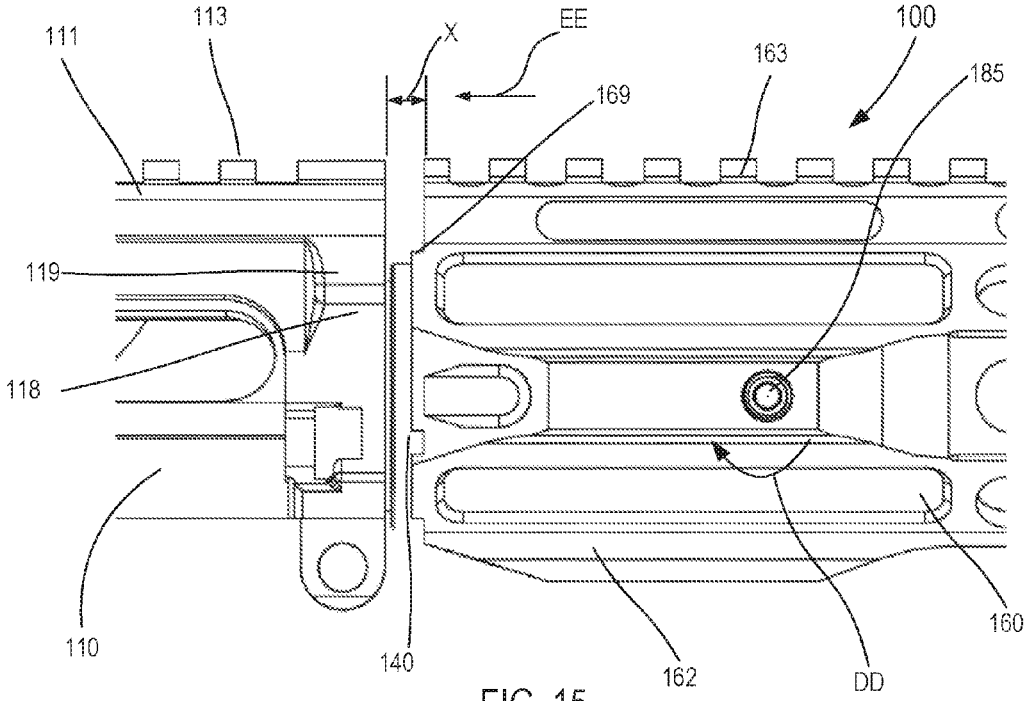
FIGS. 15 and 16 are side views of the portion of the firearm assembly shown in FIG. 1 moving from the third configuration to a fourth configuration.

The firearm assembly 100 is then moved from the third configuration to a fourth configuration by tightening the set screws 185 within the threaded bore 175, as shown by the arrow DD in FIG. 15. When the set screws 185 move within their respective threaded bores 175 (as shown by the arrows FF in FIGS. 17 and 18), their tips 189 moves along the set screw centerline $CL_{SC}$ and into contact with the lock surface 147. Because the lock surface 147 has a conical (or frusto-conical) shape, further tightening of the set screws 185 causes the handguard 160 to move axially as shown by the arrow EE in FIGS. 15 and 18. Thus, the handguard-tightening procedure (i.e., tightening the set screws 185) moves the engagement surface 166 of the lock-up portion 167 into contact with the corresponding surface of the upper receiver 110 such that the handguard 160 abuts the upper receiver 110. This arrangement reduces and/or eliminates any gap (identified as gap X in FIG. 15) between the engagement surface 166 and the upper receiver 110.

Because the set screws 185 are configured to engage a conical (or frusto-conical) lock surface 147 that extends circumferentially about the lock nut 140, the set screws 185 (and thus the handguard 160) need not be indexed and/or circumferentially aligned with any portion of the barrel nut 140 to accommodate mounting of the handguard 160 to the barrel nut 140. Additionally, because the handguard-tightening procedure moves the protrusions 169 into position against the first side 119 and the second side 120, the handguard 160 is fixed in a rotational position relative to (and properly aligned with) the upper receiver 110. Similarly stated, the barrel nut 140 and the handguard 160 are collectively configured such that the handguard 160 can be disposed about the barrel nut 140 without adjusting the rotational position of the barrel nut 140 relative to the upper receiver 110.

Figure 19:
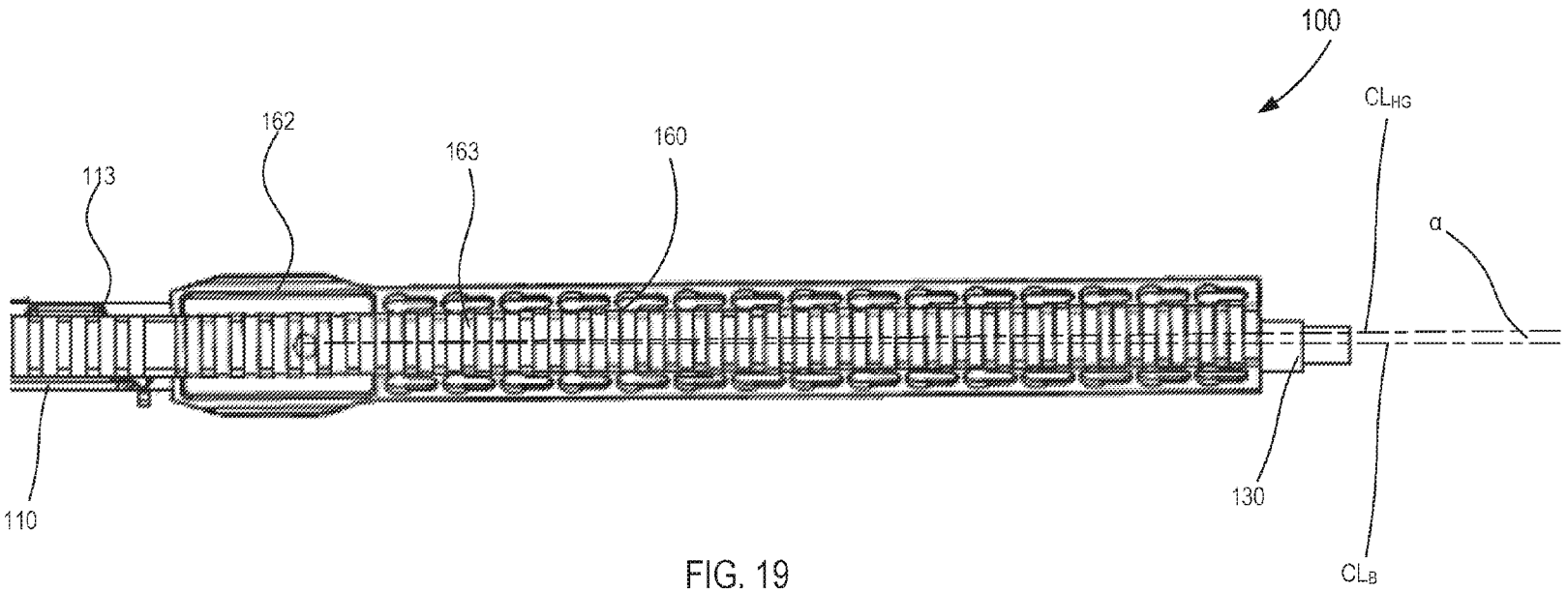
FIG. 19 is a top view the portion of the firearm assembly shown in FIG. 1 in the fourth configuration.

In some embodiments, the handguard 160 and the barrel nut 140 can be configured to provide the free-floating connection described herein having a maximum angular offset $\alpha$ along the center line $CL_B$ of the barrel 130. As shown in FIG. 19, the angular offset $\alpha$ is shown as being the maximum angle defined by the center line $CL_{HG}$ of the handguard 160 and the center line $CL_B$ of the barrel 130 when the when the handguard 160 is disposed about the barrel nut 140 (in the fourth configuration). In some embodiments, the maximum angular offset $\alpha$ is less about ±0.25 degrees (for a total of about 0.5 degrees). In other embodiments, the maximum angular offset $\alpha$ is less about ±0.1 degrees (for a total of about 0.2 degrees). In yet other embodiments, the maximum angular offset $\alpha$ is less about ±0.05 degrees (for a total of about 0.1 degrees). In yet other embodiments, the maximum angular offset $\alpha$ is less about ±0.025 degrees (for a total of about 0.05 degrees).

In some embodiments, the axial alignment between the handguard 160 and the barrel 130 can be produced without any additional alignment steps and/or tightening sequences of the set screws 185. For example, as shown in FIGS. 7 and 18, when the firearm assembly 100 is in the fourth (or locked-up) configuration, the first engagement surface 144 and the second engagement surface 145 contact and/or engage the internal mounting surface 173 of the handguard 160 along the total engagement length $L_T$. The total engagement length $L_T$ can be any suitable amount, and can be selected to produce the desired axial alignment of the handguard 160 and the barrel 130. In some embodiments, the total engagement length $L_T$ can be about 57.2 mm (2.25 inches). In other embodiments, the total engagement length $L_T$ can be between about 50.8 mm (2 inches) and about 63.5 mm (2.5 inches). In other embodiments, the total engagement length $L_T$ can be between about 44.5 mm (1.75 inches) and about 57.2 mm (2.25 inches).

In some embodiments, the total engagement length $L_T$ can be any suitable amount relative to the outer diameter $OD_n$ of the barrel nut 140. For example, in some embodiments, the ratio of the length $L_1$ of the first engagement surface 144 to the outer diameter $OD_n$ is at least about 0.5. In other embodiments, the ratio of the length $L_1$ of the first engagement surface 144 to the outer diameter $OD_n$ is at least about 0.75. In some embodiments, the ratio of the length $L_2$ of the second engagement surface 145 to the outer diameter $OD_n$ is at least about 0.3. In other embodiments, the ratio of the length $L_2$ of the second engagement surface 145 to the outer diameter $OD_n$ is at least about 0.5. In some embodiments, the ratio of the total engagement length $L_T$ to the outer diameter $OD_n$ is at least about 1.25. In other embodiments, the ratio of the total engagement length $L_T$ to the outer diameter $OD_n$ is at least about 1.0. In yet other embodiments, the ratio of the total engagement length $L_T$ to the outer diameter $OD_n$ is at least about 0.75.

Additionally, the tolerance between the outer diameter of the first engagement surface 144 and the second engagement surface 145 (indicated as the outer diameter $OD_n$ in FIG. 7) and the inner diameter of the mounting surface 173 of the handguard 160 (referred to as the "handguard/barrel nut tolerance") can be selected to produce the desired axial alignment of the handguard 160 and the barrel 130. For example, in some embodiments, the handguard/barrel nut tolerance can be less than about 0.05 mm (0.002 inches) per side. In other embodiments, the handguard/barrel nut tolerance can be less than about 0.025 mm (0.001 inches) per side.

Figure 20:
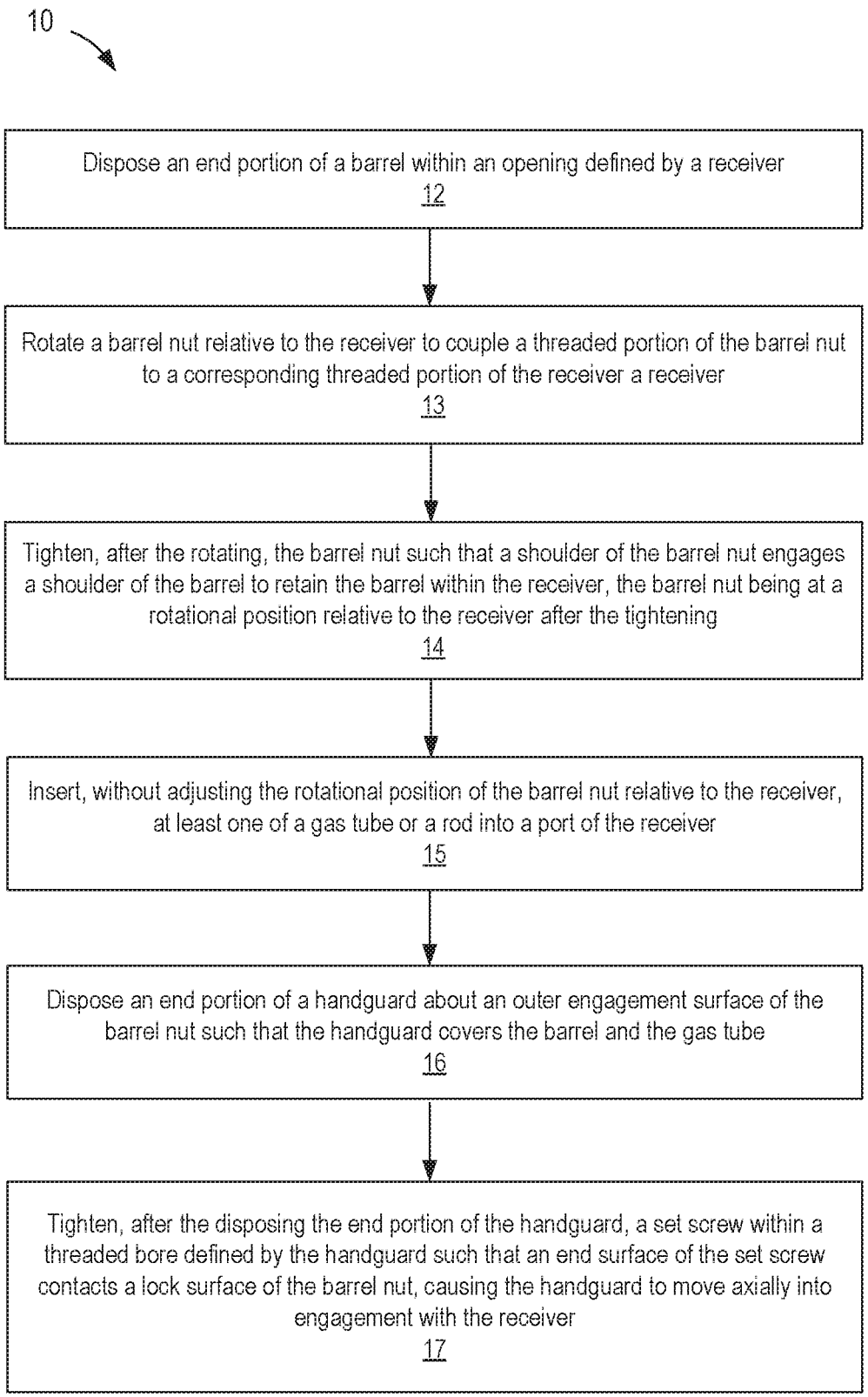
FIG. 20 is a flow chart of a method of assembling a portion of a firearm according to an embodiment.

FIG. 20 is a flow chart illustrating a method 10 of assembling a firearm, according to an embodiment. The method 10 can be performed using any of the components (e.g. barrel nuts, handguards, etc.) or kits shown and described herein. The method includes disposing an end portion of a barrel within an opening defined by a receiver, at 12. The barrel can be, for example, the barrel 130 shown and described above. The receiver can be, for example, the upper receiver 110 shown and described above. A barrel nut, such as the barrel nut 140, is rotated relative to the receiver to couple a threaded portion of the barrel nut to a corresponding threaded portion of the receiver, at 13.

The method includes tightening, after the rotating, the barrel nut such that a shoulder of the barrel nut engages a shoulder of the barrel to retain the barrel within the receiver, at 14. As described above, the barrel nut is characterized as being at a rotational position relative to the receiver after the tightening. The method includes inserting, without adjusting the rotational position of the barrel nut, at least one of a gas tube or a rod into a port of the receiver, at 15. The port can be, for example, the gas port (such as the gas port 117) within which the gas tube is disposed as a part of a "gas direct" system. The port can also be a port configured to receive the rod (or any other suitable mechanical linkage) in a gas-cylinder system. The method allows for the installation of the gas tube or the rod without indexing or circumferentially aligning the barrel nut.

The end portion of a handguard is disposed about an outer engagement surface of the barrel nut such that the handguard covers the barrel and the at least one of the gas tube or the rod, at 16. The handguard can be, for example, the handguard 160 or any other suitable handguard. The method then includes tightening a set screw within a threaded bore defined by the handguard such that an end surface of the set screw contacts a lock surface of the barrel nut, causing the handguard to move axially into engagement with the receiver, at 17. In some embodiments, for example, the lock surface can be a frusto-conical surface, similar to the lock surface 147 described above, and the set screw can contact the surface to produce translation of the handguard.

In some embodiments, any of the components described herein can be included within a kit. For example, in some embodiments, a kit includes a barrel nut, a handguard, and a series of set screws disposed in the handguard. The kit can further include the associated packaging, lubricants, accessories and/or an instruction set. In such embodiments, the kit can be used in conjunction with any suitable receiver or barrel of an automatic or semi-automatic firearm, a bolt-action firearm, a paintball firearm and/or an airsoft or "replica" firearm.

Figure 21:
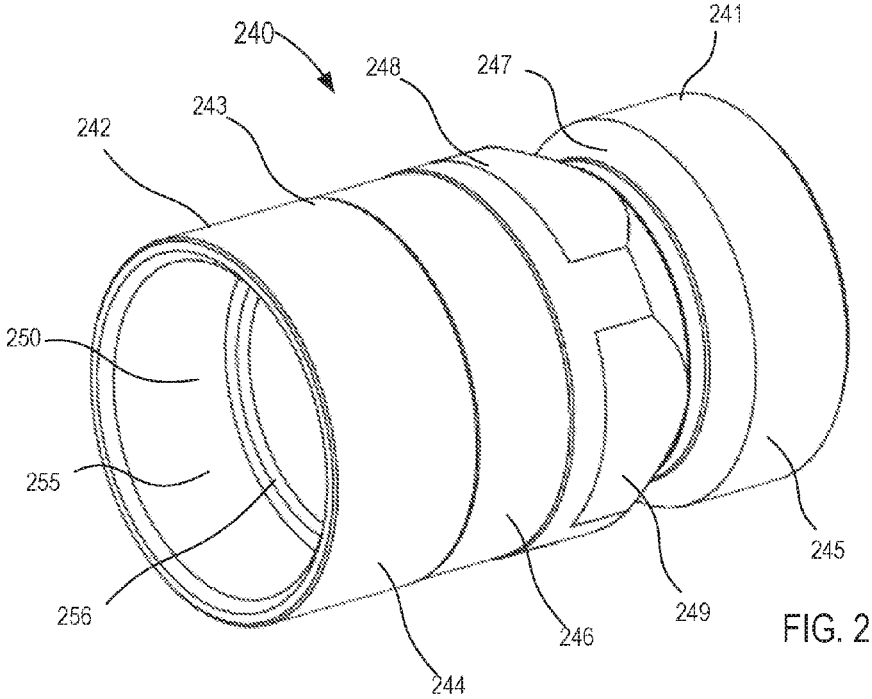
FIGS. 21 and 22 are a side perspective view and a cross-sectional view, respectively, of a barrel nut according to an embodiment.
Figure 22:
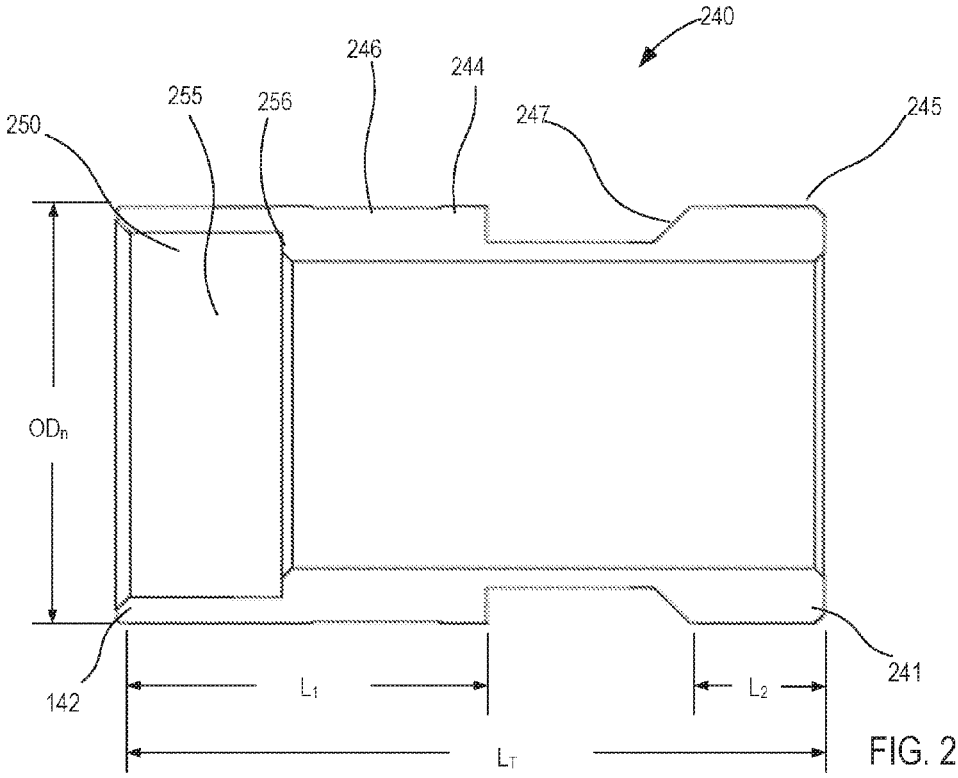

Although the barrel nut 140 is shown and described above as including a single lock surface 147, in other embodiments, a barrel nut can include any number of lock surfaces, against which a series of set screws or other fasteners can engage to limit movement of the handguard in at least one direction. For example, FIGS. 21 and 22 show a barrel nut 240 according to an embodiment. The barrel nut 240 includes a proximal (or receiver) end portion 242 and a distal (or barrel) end portion 241. The barrel nut 240 also includes an outer portion 243 and an inner portion 250. The inner portion 250 includes a threaded portion 255 and a shoulder 256, and defines a bore within which a barrel (e.g., barrel 130 or any suitable barrel) can be disposed. More specifically, the threaded portion 255 is at the proximal end portion 242, and includes threads (not shown) that correspond to and/or are matingly engaged with the threaded portion (not shown) of the upper receiver 110 (see FIG. 23). The shoulder 256 is sized to engage a corresponding shoulder of the barrel. In this manner, when the barrel nut 240 is tightened onto the upper receiver 110, the shoulder 256 engages the barrel shoulder to retain the barrel within the upper receiver 110.

The outer portion 243 of the barrel nut 240 includes a tool engagement portion 248 that defines a series of flats 249. Similar to the tool engagement portion 148 of the barrel nut 140, the flats are sized and configured such that a wrench or other tool can engage the outer portion 243 of the barrel nut 240 to tighten the barrel nut 240 onto the upper receiver 110. The outer portion 243 of the barrel nut 240 also includes a first engagement surface 244, a second engagement surface 245, a first lock surface 246, and a second lock surface 247. As described above, the first engagement surface 244 and the second engagement surface 245 are sized and configured to engage an internal mounting surface of the handguard 260. More specifically, the first engagement surface 244 is a cylindrical surface having a length $L_1$ and the second engagement surface 245 is a cylindrical surface having a length $L_2$. Thus, when the handguard 260 is disposed about and/or engaged with the barrel nut 240, the total length of engagement between the mounting surface of the handguard 260 and the outer portion 243 of the barrel nut 240 extends from the proximal-most end of the first engagement surface 244 to the distal-most end of the second engagement surface 245. This is shown in FIG. 22 by the length $L_T$.

The first lock surface 246 is disposed between the first engagement surface 244 and the tool engagement portion 248, and defines a recessed portion that contacts a set screw 284 of the handguard 260. More specifically, as shown in in FIG. 23 the set screw 284 (which can be one of a series of set screws) is threadedly engaged within the handguard 260 such that when the set screw 284 is tightened, the tip of the set screw contacts the first lock surface 246 to limit movement of the handguard 260 relative to the barrel nut 240. The recessed shape of the first lock surface 246 is such that any burrs or surface imperfections caused by the impingement of the tip against the first lock surface 246 will be below the overall outer diameter $OD_n$ of the barrel nut 240, thereby allowing the handguard 260 to be repeated removed and installed about the barrel nut 240. In some embodiments, the tip (not shown) of the set screw 284 can be flatted such that it is substantially parallel to a tangent line of the first lock surface 246. In this manner, the surface area of engagement between the tip of the set screw 284 and the first lock surface 246 can be maximized.

The second lock surface 247 of the barrel nut 240 is disposed between the first engagement surface 244 and the second engagement surface 245, and defines a frusto-conical shape that contacts a set screw 285 of the handguard 260. The set screw 285 (which can be one of a series of set screws) can be threadedly engaged within the handguard 260 such that when the set screw 285 is tightened, the tip of the set screw contacts the second lock surface 247. As described above with reference to the barrel nut 140, the frusto-conical shape of the second lock surface 247 is such that further tightening of the set screw 285 moves the handguard 260 axially (i.e., along a center line of the handguard) to engage the upper receiver 110. The second lock surface 247 can have any suitable conical or frusto-conical shape that forms a non-zero angle θ with a center line of the barrel nut 240, the first engagement surface 244, and or the second engagement surface 245.

The outer portion 243 of the barrel nut 240 (including the first engagement surface 244 and/or the second engagement portion 245) defines the outer diameter $OD_n$. The outer diameter $OD_n$ is sized such that when the barrel nut 240 is tightened to the upper receiver 110, the gas port (not shown in FIG. 23) is exposed independent of a rotational position of the barrel nut 240 relative to the receiver 210. In this manner, the barrel nut 240 can be tightened about the receiver 110 without being indexed and/or circumferentially aligned to allow a gas tube or a rod (not shown) to be connected to the gas port, as described herein.

Figure 23:
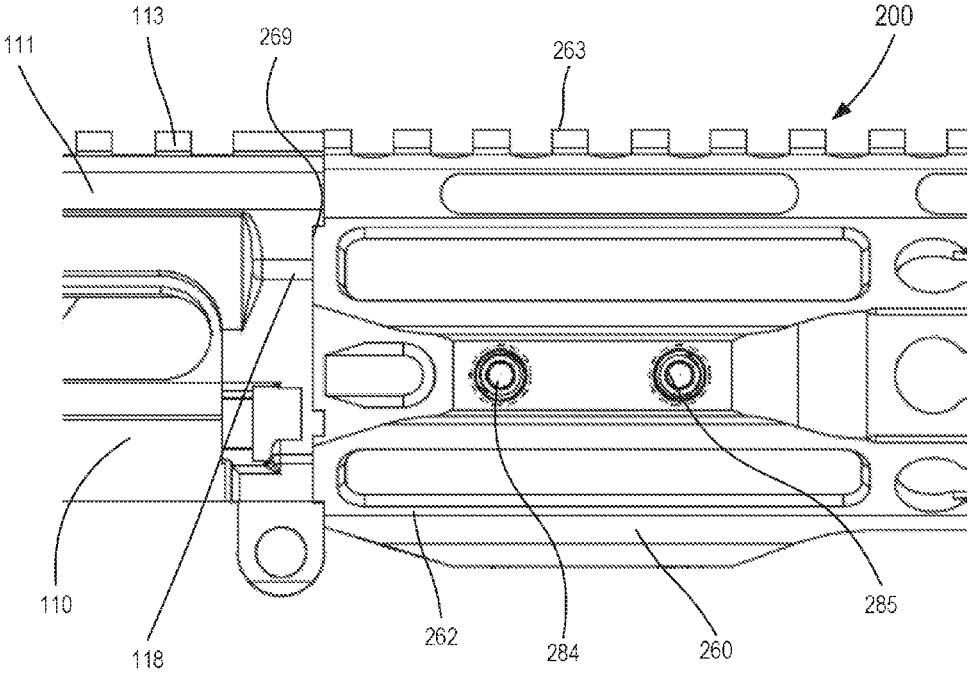
FIG. 23 is a side view of the portion of a firearm assembly including the barrel nut shown in FIGS. 21 and 22.

As shown in FIG. 23, the handguard 260 is similar to the handguard 160 described above. The handguard includes a proximal (or receiver) end portion 262 and includes an accessory rail 263, such as a Picatinny rail. The proximal end portion 262 includes a receiver engagement (or lock-up) portion that includes an engagement surface and a pair of protrusions 269. When the handguard 260 is coupled to the upper receiver 110, the engagement surface is in contact with the corresponding surface of the upper receiver 110 such that the handguard 260 abuts the upper receiver 110. The protrusions (or anti-rotation lugs) 269 contact the upper receiver 110 to limit rotation of the handguard 260 relative to the upper receiver 110, as described above.

The handguard defines a first series of set screw bores within which the first series of set screws 284 are threadedly engaged. The handguard defines a second series of set screw bores within which the second series of set screws 285 are threadedly engaged. The set screws 284 and the set screws 285 are rotated within the handguard 260 to move the handguard 260 into position against the upper receiver 110 and also to lock the handguard 260 into place about the barrel nut 240.

Figure 24:
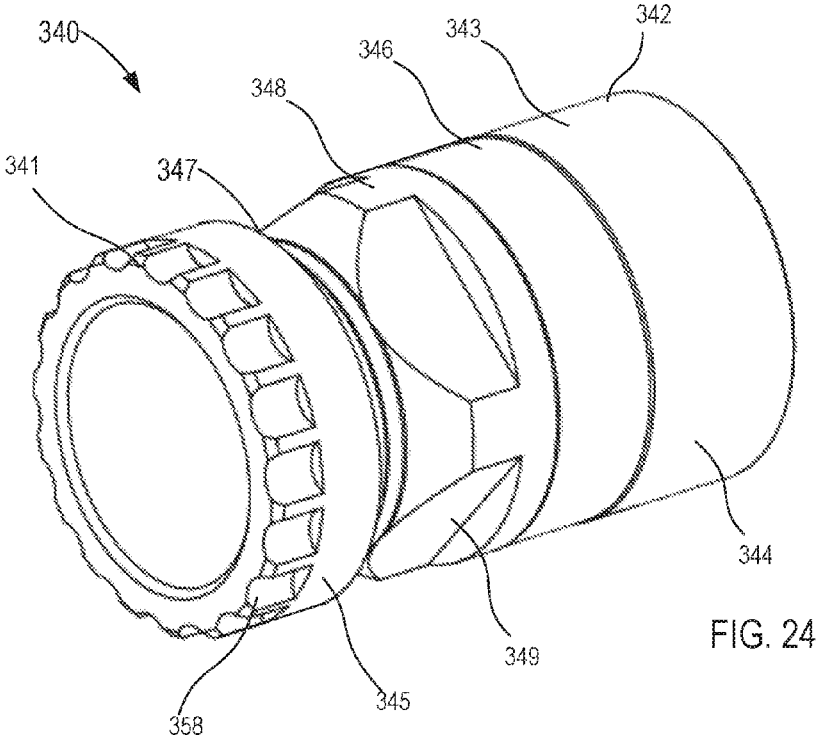
FIG. 24 is a side perspective view of a barrel nut according to an embodiment.

Although the barrel nuts described herein are shown as having a tool engagement portion having a series of flats, in other embodiments, a barrel nut can include multiple tool engagement portions. For example, FIG. 24 shows a barrel nut 340 according to an embodiment. The barrel nut 340 is similar in many respects to the barrel nut 140 and the barrel nut 240 shown and described herein, and is therefore not described in detail below. Further, the barrel nut 340 can include any features as described above for the barrel nut 140 and the barrel nut 240. As shown, the barrel nut 340 includes a proximal (or receiver) end portion 342 and a distal (or barrel) end portion 341. The barrel nut 340 also includes an outer portion 343 that includes a first tool engagement portion 348 and a second tool engagement portion 358. The first tool engagement portion 348 defines a series of flats 349. Similar to the tool engagement portion 148 of the barrel nut 140, the flats are sized and configured such that a wrench or other tool can engage the outer portion 343 of the barrel nut 340 to tighten the barrel nut 340 onto a firearm receiver. The second tool engagement portion 358 includes a series of recesses and/or indentations configured to receive the lugs of a tool, such as a "MIL-SPEC" tool used to tighten the barrel nut 340.

The outer portion 343 of the barrel nut 340 also includes a first engagement surface 344, a second engagement surface 345, a first lock surface 346, and a second lock surface 347. As described above, the first engagement surface 344 and the second engagement surface 345 are sized and configured to engage an internal mounting surface of a handguard, such as the handguard 160 or the handguard 260. The first lock surface 346 and the second lock surface 347 can be similar to the first lock surface 246 and the second lock surface 247 described above.

Figure 25:
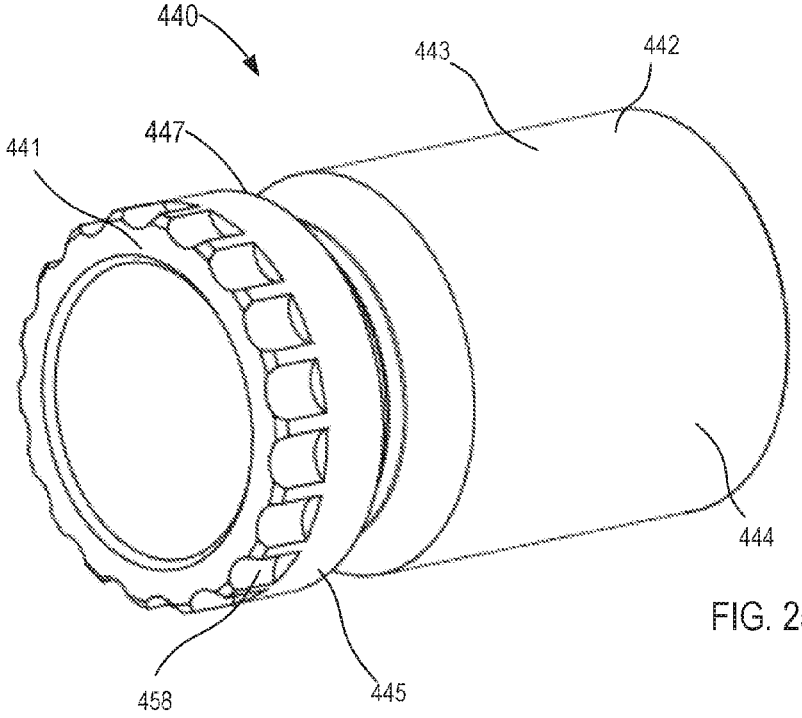
FIG. 25 is a side perspective view of a barrel nut according to an embodiment.

FIG. 25 shows a barrel nut 440 according to an embodiment. The barrel nut 440 is similar in many respects to the barrel nut 140 and the barrel nut 240 shown and described herein, and is therefore not described in detail below. Further, the barrel nut 440 can include any features as described above for the barrel nut 140 and the barrel nut 240. As shown, the barrel nut 440 includes a proximal (or receiver) end portion 442 and a distal (or barrel) end portion 441. The barrel nut 440 also includes an outer portion 443 that includes a tool engagement portion 458. The tool engagement portion 458 includes a series of recesses and/or indentations configured to receive the lugs of a tool, such as a "MIL-SPEC" tool used to tighten the barrel nut 440.

The outer portion 443 of the barrel nut 440 also includes a first engagement surface 444, a second engagement surface 445, and a lock surface 447. As described above, the first engagement surface 444 and the second engagement surface 445 are sized and configured to engage an internal mounting surface of a handguard, such as the handguard 160 or the handguard 260. The lock surface 347 can be similar to the lock surface 247 described above.

While various embodiments of the invention have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above. For example, although the method 10 is described above as including the operation of inserting the gas tube or rod into a port of the receiver before handguard is disposed about the barrel nut, in other embodiments, a gas tube or rod can be disposed into a port after the handguard is disposed about the barrel nut.

As another example, although the barrel nuts described herein include female (or internal) threads that engage with corresponding male (or external) threads of an upper receiver, in other embodiments, any of the barrel nuts described herein, such as the barrel nut 140, can include a male-threaded portion that mates with a female threaded portion of an upper receiver.

Although the barrel nut 140 is shown and described as including a tool engagement portion 148, in other embodiments, the barrel nut 140 (and any of the other barrel nuts described herein) need not include a distinct tool engagement portion. For example, in some embodiments, a barrel nut can include a cylindrical engagement surface (e.g., the engagement surface 144) that receives a wrench (e.g., a pipe wrench or the like) and to which the handguard is mounted.

Although the engagement surfaces (e.g., surfaces 144 and 145) of the barrel nut are shown and described as being cylindrical, in other embodiments, the engagement surfaces of any of the barrel nuts described herein need not be cylindrical. Similarly, although the inner volume $V_{HG}$ of the handguard 160 is shown and described as being cylindrical, in other embodiments, the inner volume $V_{HG}$ of the handguard 160 (and any of the handguards described herein) can be any suitable shape. For example, in some embodiments, a barrel nut can define a substantially cylindrical engagement surface and a handguard can define a corresponding mounting surface that includes a series of flats, cutouts or the like (i.e., a surface that is partially cylindrical). In other embodiments, a handguard can define a substantially cylindrical mounting surface and a barrel nut can define a corresponding engagement surfaces that includes a series of flats, cutouts or the like (i.e., a surface that is partially cylindrical). In such embodiments, for example, the circumferential engagement between the barrel nut and the handguard can be less than 360 degrees. For example, in some embodiments, the circumferential engagement can include alternating segments of engagement that produce a total circumferential engagement of between about 330 degrees and about 360 degrees. In other embodiments, the circumferential engagement can include alternating segments of engagement that produce a total circumferential engagement of between about 300 degrees and about 330 degrees. In yet other embodiments, the circumferential engagement can include alternating segments of engagement that produce a total circumferential engagement of less than about 300 degrees, less than about 270 degrees, less than about 240 degrees, less than about 210 degrees, less than about 180 degrees, less than about 150 degrees, or less than about 120 degrees.

Although the handguard 160 is shown and described as being used with the barrel nut 140, in other embodiments, the handguard 160 can be used with any suitable barrel nut. For example, in some embodiments, the handguard 160 can be used with a barrel nut that has a series of internal bores (not shown herein), one of which is aligned with the gas port (e.g., gas port 117) during installation.

Although the barrel nut 140 is shown and described as having a first engagement surface 144 that engages and/or contacts a first portion of the mounting surface 173 of the handguard 160 and a second engagement surface 145 that engages and/or contacts a second portion of the mounting surface 173 of the handguard 160, in other embodiments, a barrel nut can have any suitable number of engagement surfaces. For example, in some embodiments, a barrel nut can include a single engagement surface that extends for the total length of engagement between the handguard and the barrel nut. In other embodiments, a barrel nut can include three or more distinct engagement surfaces that collectively extend for the total length of engagement between the handguard and the barrel nut.

Moreover, although the barrel nut 140 is shown and described as having a first engagement surface 144 and a second engagement surface 145 that have the same diameter, in other embodiments, a barrel nut can two or more engagement surfaces that have different sizes, lengths and/or diameters. For example, in some embodiments, the first engagement surface 144 can have a first outer diameter that is larger than an outer diameter of the second engagement surface 145. In such embodiments, the mounting surface 160 of the handguard can also include two distinct portions: a first portion corresponding to the first engagement surface and a second portion (having a different size) corresponding to the second engagement surface.

Although the handguard 160 is shown and described as including a mounting surface 173 that is continuous and that engages and/or contacts the first engagement surface 144 and the second engagement surface 145 of the barrel nut 140, in other embodiments, the handguard 160 (and any of the handguards shown and described herein) can include any number of distinct, discontinuous and/or non-contiguous mounting surfaces that engage an outer surface of a barrel nut.

Although the lock surface 147 of the barrel nut is shown and described as being disposed between the first engagement surface 144 and the second engagement surface 145, in other embodiments, the lock surface can be in any position along the outer surface of a barrel nut. For example in some embodiments, a barrel nut can include a single engagement surface, and the lock surface can be disposed either distally or proximally from the engagement surface. In other embodiments, the lock surface can be disposed either distally or proximally from the first engagement surface and the second engagement surface.

Although the barrel nuts (such as the barrel nut 140) are shown and described herein as being configured and/or sized such that the gas port is exposed independent of the rotational position about the receiver (i.e., within the full rotational range of 360 degrees), in other embodiments, a barrel nut can be configured such that the gas port is exposed over a predetermined angular range. For example, in some embodiments, a barrel nut can be configured and/or sized such that the gas port is exposed when the barrel nut is within a range of zero to about 330 degrees, zero to about 300 degrees, zero to about 270 degrees, zero to about 240 degrees, zero to about 210 degrees, zero to about 180 degrees, or any ranges or subranges therebetween.

Although the gas ports described herein, such as the gas port 117, have been described as receiving a gas tube through which a portion of a gas is conveyed into the receiver, in other embodiments, a gas port can receive a piston or other mechanical linkage that transmits a gas-produced pressure to the receiver. Thus, in some embodiments, the barrel nut 140 and/or the handguard 160 (or any of the barrel nuts and handguards described herein) can be used with a gas piston design that includes a mechanical rod that moves within a port in the upper receiver. Said another way, although the firearm assemblies described herein have been described as being "gas direct" systems that include a gas tube coupled to a gas port of the upper receiver, any of the barrel nuts, handguards, and coupling components described herein can be used in any suitable semi-automatic or automatic firearm to eliminate the need for indexing (or circumferentially aligning) the barrel nut with the upper receiver and/or the handguard to accommodate any automatic cycling mechanism coupled between the barrel and the receiver.

Moreover, although the firearm assemblies have been generally described herein as being semi-automatic or automatic firearms, any of the barrel nuts, handguards, other components, and/or methods of assembly described herein can be used in conjunction with any suitable firearm, including a automatic or semi-automatic firearm, a bolt-action firearm, a paintball firearm and/or an airsoft or "replica" firearm.

Although the barrel nuts shown and described herein are substantially solid and monolithically constructed, in other embodiments, a barrel nut can include cross-drillings to remove material, thereby reducing the weight of the barrel nut. In other embodiments, a barrel nut, such as the barrel nut 140, can be constructed from multiple components that are later joined together. For example, in some embodiments, a barrel nut can include a lock surface that is a separately constructed ring that is later joined to the body of the barrel nut.

Any of the barrel nuts and components shown and described herein can be constructed from any suitable material. For example, any of the barrel nuts described herein can be constructed from aluminum alloys including but not limited to 6061, 6060, 6013, 6063, 2024, 2011, 6020, 7068, 7075, Steel alloys including but not limited to A36, 4140, 4130, 4340, 1144, 1145, 1018, S7, A2, O1, 8620, 9310, 303SS, 304SS, 316SS, 416SS, 420SS, 440SS, Titanium alloys including but not limited to Grade 2, Grade 5, Brass, Bronze, and non-metals including but not limited to Garolite, Carbon Fiber, and polymers.

Although various embodiments have been described as having particular features and/or combinations of components, other embodiments are possible having a combination of any features and/or components from any of embodiments where appropriate.

What is claimed is:

1. An apparatus, comprising:

a handguard configured to engage a receiver, the handguard including a first protrusion having a first surface and a second protrusion having a second surface, the first surface and the second surface defining a taper angle therebetween; and a barrel nut having an inner portion and an outer portion, the inner portion including a threaded portion and a shoulder, the shoulder configured to engage a shoulder of a barrel to retain the barrel within the receiver when the threaded portion is coupled to a corresponding threaded portion of the receiver, the outer portion of the barrel nut defining an outer diameter such that a gas port of the receiver is exposed independent of a rotational position of the barrel nut relative to the receiver, the outer portion of the barrel nut including an engagement surface and a lock surface, the engagement surface configured to engage a mounting surface of the handguard, the lock surface defining a frusta-conical shape configured to contact a set screw threadedly engaged with the handguard such that rotational movement of the set screw moves the handguard axially relative to the barrel nut, the first surface of the first protrusion configured to engage an outer surface of the receiver on a first side of a receiver rail and the second surface of the second protrusion configured to engage the outer surface of the receiver on a second side of the receiver rail when the mounting surface of the handguard is disposed about the engagement surface of the barrel nut.

2. The apparatus of claim 1, wherein:

the engagement surface has a cylindrical shape corresponding to a shape of the mounting surface of the handguard; and a ratio of an axial length of the engagement surface to the outer diameter is at least 0.5.

3. The apparatus of claim 1, wherein the engagement surface is a first engagement surface having a cylindrical shape corresponding to a shape of a first portion of the mounting surface of the handguard, the outer portion having a second engagement surface having a cylindrical shape corresponding to a shape of a second portion of the mounting surface.

4. The apparatus of claim 3, wherein the lock surface is between the first engagement surface and the second engagement surface.

5. The apparatus of claim 3, wherein:

the lock surface is between the first engagement surface and the second engagement surface; and a ratio of an overall axial length of the first engagement surface and the second engagement surface to the outer diameter is at least 1.0.

6. The apparatus of claim 1, wherein:

the set screw is a first set screw from a plurality of set screws; and the handguard defines a plurality of threaded bores, a longitudinal centerline of each threaded bore from the plurality of threaded bores intersecting with a longitudinal centerline of the barrel nut, each set screw from the plurality of set screws configured to be threadedly engaged within a corresponding threaded bore from the plurality of threaded bores such that rotational movement of each set screw from the plurality of set screws within the corresponding threaded bore from the plurality of threaded bores moves each set screw into contact with the lock surface.

7. The apparatus of claim 1, wherein the handguard defines a threaded bore within which the set screw is threadedly engaged, a longitudinal centerline of the threaded bore substantially normal to and intersecting a longitudinal centerline of the barrel nut.

8. An apparatus, comprising:

a handguard including a receiver engagement portion and a mounting surface, the receiver engagement portion configured to engage an outer surface of a receiver to limit rotation of the handguard relative to the receiver, the mounting surface defining a cylindrical volume, the handguard defining a plurality of threaded bores, each of the plurality of threaded bores configured to receive a set screw of a plurality of set screws; and a barrel nut having an inner portion and an outer portion, the inner portion including a threaded portion and a shoulder, the shoulder configured to engage a shoulder of a barrel to retain the barrel within the receiver when the threaded portion is coupled to a corresponding threaded portion of the receiver, the outer portion including an engagement surface and a lock surface, the engagement surface configured to be disposed within the cylindrical volume and engage the mounting surface of the handguard, the lock surface defining a frusto-conical shape configured to contact each set screw of the plurality of set screws that is threadedly engaged within each threaded bore from the plurality of threaded bores such that rotational movement of each set screw of the plurality of set screws moves the handguard axially relative to the barrel nut, a longitudinal centerline of each threaded bore from the plurality of threaded bores intersecting with a longitudinal centerline of the cylindrical volume.

9. The apparatus of claim 8, wherein the longitudinal centerline of each threaded bore from the plurality of threaded bores is substantially normal to the longitudinal centerline of the cylindrical volume.

10. The apparatus of claim 8, wherein the outer portion of the barrel nut defines an outer diameter such that a gas port of the receiver is exposed independent of a rotational position of the barrel nut relative to the receiver.

11. The apparatus of claim 8, wherein:

the engagement surface has a cylindrical shape corresponding to a shape of the mounting surface of the handguard; and a ratio of an axial length of the engagement surface to an outer diameter of the barrel nut is at least 0.5.

12. The apparatus of claim 8, wherein the receiver engagement portion of the handguard includes a first protrusion and a second protrusion, the first protrusion configured to contact a first side of the outer surface of the receiver, the second protrusion configured to contact a second side of the outer surface of the receiver.

13. The apparatus of claim 12, wherein a first contact surface of the first protrusion and a second contact surface of the second protrusion define an included angle of between about 4 degrees and about 30 degrees.

14. A method, comprising:

disposing an end portion of a barrel within an opening defined by a receiver;

rotating a barrel nut relative to the receiver to couple a threaded portion of the barrel nut to a corresponding threaded portion of the receiver;

tightening, after the rotating, the barrel nut such that a shoulder of the barrel nut engages a shoulder of the barrel to retain the barrel within the receiver, the barrel nut being at a rotational position relative to the receiver after the tightening;

inserting, without adjusting the rotational position of the barrel nut relative to the receiver, at least one of a gas tube or a rod into a port of the receiver;

disposing an end portion of a handguard about an outer engagement surface of the barrel nut such that the handguard covers at least a portion of the barrel and the at least one of the gas tube or the rod; and tightening, after the disposing the end portion of the handguard, a plurality of set screws within a corresponding plurality of threaded bores defined by the handguard such that an end surface of each set screw of the plurality of set screws contacts a frusto-conical lock surface of the barrel nut, causing the handguard to move axially into engagement with the receiver, a longitudinal centerline of each threaded bore from the plurality of threaded bores intersecting with a longitudinal centerline of the barrel nut.

15. The method of claim 14, wherein the disposing the end portion of the handguard is performed without adjusting the rotational position of the barrel nut relative to the receiver.

16. The method of claim 14, wherein the tightening the barrel nut is performed by applying a torque of between about 30 foot-pounds and 80 foot-pounds to the barrel nut.

17. The method of claim 14, wherein the rotational position of the barrel nut elative to the receiver is within a range of 360 degrees.

18. The method of claim 14, wherein the barrel nut defines an outer diameter such that the port of the receiver is exposed independent of the rotational position of the barrel nut relative to the receiver.

19. The apparatus of claim 1, wherein the taper angle is between about 4 degrees and between about 30 degrees.

20. The apparatus of claim 1, wherein the first surface and the second surface each face inwardly toward the outer surface of the receiver.

21. The apparatus of claim 6, wherein the longitudinal centerline of each threaded bore from the plurality of threaded bores is normal to the longitudinal centerline of the barrel nut.

22. The apparatus of claim 8, wherein the longitudinal centerline of each threaded bore from the plurality of threaded bores and the longitudinal centerline of the cylindrical volume form a set screw angle of between about 60 degrees and between about 120 degrees.

23. The apparatus of claim 12, wherein a first contact surface of the first protrusion is configured to engage an outer surface of the receiver on a first side of a receiver rail and a second contact surface of the second protrusion is configured to engage the outer surface of the receiver on a second side of the receiver rail.

24. The method of claim 14, where at least one of the disposing the end portion of the handguard or the tightening the plurality of set screws moves a first engagement surface of the handguard into contact with an outer surface of the receiver on a first side of a receiver rail and moves a second engagement surface of the handguard into contact with the outer surface of the receiver on a second side of the receiver rail, the first engagement surface and the second engagement surface defining a taper angle therebetween.

* * * * *